US011680364B2

(12) United States Patent
Lim et al.

(10) Patent No.: US 11,680,364 B2
(45) Date of Patent: Jun. 20, 2023

(54) METHOD OF CONTROLLING GARMENT FOLDING MACHINE

(71) Applicant: LG Electronics Inc., Seoul (KR)

(72) Inventors: Choongho Lim, Seoul (KR); Keun Joo Kim, Seoul (KR); Kyosoon Chae, Seoul (KR); Sung Hoon Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 27 days.

(21) Appl. No.: 17/330,005

(22) Filed: May 25, 2021

(65) Prior Publication Data

US 2021/0363686 A1 Nov. 25, 2021

(30) Foreign Application Priority Data

May 25, 2020 (KR) ..... 10-2020-0062394

(51) Int. Cl.
*D06F 89/02* (2006.01)

(52) U.S. Cl.
CPC ..... *D06F 89/02* (2013.01)

(58) Field of Classification Search
CPC ..... D06F 89/00; D06F 89/02; D06F 89/023; A41H 43/025; A41H 43/0257
See application file for complete search history.

(56) References Cited

U.S. PATENT DOCUMENTS 3,003,760 A * 10/1961 Scheu, Jr. ..... D06F 89/00 493/27
3,806,009 A * 4/1974 Glaze, Jr. ..... B65B 25/20 223/112
3,918,699 A * 11/1975 Arbter ..... D06F 89/00 493/405
5,300,007 A * 4/1994 Kober ..... D06F 89/00 493/450
9,752,277 B2 * 9/2017 Nakahara ..... D06F 69/00
10,183,830 B2 * 1/2019 Hsu ..... B65H 45/24
10,583,948 B2 * 3/2020 Stollery ..... B65B 35/50
(Continued)

FOREIGN PATENT DOCUMENTS

KR 20170095620 8/2017
KR WO2019130316 4/2019
(Continued)

OTHER PUBLICATIONS

International Search Report in International Appln. No. PCT/KR2021/006479, dated Sep. 17, 2021, 6 pages (with English translation).

*Primary Examiner* — F Griffin Hall
(74) *Attorney, Agent, or Firm* — Fish & Richardson P.C.

(57) ABSTRACT

The present disclosure relates to a method of controlling a garment folding machine, which may effectively prevent damage to a drive motor and a loss of power caused by an overload of the drive motor by accurately detecting and determining a situation in which garments are lumped during a process of conveying or folding the garments, may effectively prevent damage to the lumped garments and related components, and may significantly reduce the time for which the operation of the folding machine is stopped by accurately specifying the position at which the garments are lumped and then notifying a user of the position to allow the user to take an immediate action.

15 Claims, 17 Drawing Sheets

(56) References Cited

U.S. PATENT DOCUMENTS

| | | | | |
|---|---|---|---|---|
| 11,208,757 | B2 * | 12/2021 | Bringewatt | D06F 67/10 |
| 11,214,916 | B2 * | 1/2022 | Maeshima | D06F 89/00 |
| 11,261,562 | B2 * | 3/2022 | Nitschmann | D06F 89/023 |
| 2012/0329628 | A1 * | 12/2012 | Abt | B65H 45/04 493/416 |
| 2018/0163342 | A1 * | 6/2018 | Kitagawa | D06F 89/00 |
| 2020/0340171 | A1 * | 10/2020 | Naor | D06F 89/00 |
| 2020/0385918 | A1 * | 12/2020 | Naor | D06F 89/00 |

FOREIGN PATENT DOCUMENTS

| | | | | |
|---|---|---|---|---|
| KR | 102026187 | | 9/2019 | |
| KR | 20200028826 | | 3/2020 | |
| KR | 20200042936 | | 4/2020 | |
| WO | WO-2014037701 | A1 * | 3/2014 | A61B 42/40 |

* cited by examiner

METHOD OF CONTROLLING GARMENT FOLDING MACHINE

CROSS-REFERENCE TO RELATED APPLICATION

This application claims the benefit of priority to Korean Application No. 10-2020-0062394, filed on May 25, 2020, the disclosure of which is incorporated by reference in its entirety.

TECHNICAL FIELD

The present disclosure relates to a method of controlling a garment folding machine, and more particularly, to a method of controlling a garment folding machine, which is capable of accurately detecting and determining a situation in which garments are lumped or caught during a process of conveying and folding the garments.

BACKGROUND

Garments are made of soft materials such as natural fibers or synthetic fibers and need to be folded to appropriate sizes and shapes so that the garments are stored and carried.

Usually, it is necessary to perform a process of folding the garments significantly often or perform a process of folding a large quantity of garments in order to accommodate the garments after washing the garments or to store the garments for a long period of time in accordance with a change in season. However, a process of manually and directly folding the garments causes a waste of time and resources. In a case in which the garments are folded by unskilled persons, the shapes and the sizes of the folded garments are not uniform, which causes a problem in that additional labor is required to fold the garments for the purpose of displaying or storing the garments.

Therefore, there is a gradually increasing need for an automatic folding machine capable of quickly folding a garment without variation.

Regarding the garment folding machine in the related art, International Patent Publication No. 2018-122841 (hereinafter, referred to as a 'related art document') discloses a configuration of a folding machine in which a garment is loaded from above, folded, and then discharged while moving downward and passing through a plurality of folding layers stacked in multiple stages.

However, the folding machine disclosed in the related art document is configured to accommodate the garments by stacking the completely folded garments by allowing each of the garments to simply fall by its weight onto an unloading unit disposed at a lower side and provided in the form of a drawer.

Therefore, in the case in which the folded garments are stacked simply only by their weights as described above, volumes of the folded garments are kept expanded.

Because thicknesses of the garments are not uniform, stability of the garments in an upward/downward direction becomes low in the state in which the garments are stacked. In particular, there is a problem in that the stacked garments are highly likely to fall down in a horizontal direction during a process of opening the drawer.

In addition, because the folded garments have the expanded volumes, the number of garments, which can be accommodated in the drawer, is inevitably highly limited. When the number of garments exceeds the number of garments that can be accommodated in the drawer, the folding machine cannot operate any further, which causes a problem that an overall operating time of the folding machine is inevitably limited.

PATENT DOCUMENT (Patent Document 0001) International Patent Publication No. 2018-122841

SUMMARY

The present disclosure has been made in an effort to solve the above-mentioned problems, an object of the present disclosure is to provide a method of controlling a garment folding machine, which uses a stack plate provided to be movable in an upward/downward direction and compresses folded garments after the folded garments are stacked, thereby improving stability of the stacked garments and increasing the number of garments that can be accommodated in a drawer.

Another object of the present disclosure is to provide a method of controlling a garment folding machine, which is capable of improving operational stability and reliability by avoiding an overload situation that may occur in a stack plate motor during a process of compressing garments stacked by using a stack plate.

In one aspect, the present disclosure provides a method of controlling a garment folding machine, the method including: a primary garment seating step of primarily seating a garment delivered from a plurality of folding layers on an unloading conveyor in an unloading layer; a secondary garment seating step of secondarily seating the garment on a stack plate of a stack module by delivering the garment primarily seated in the primary garment seating step to the stack plate from the unloading conveyor; and a garment compressing step of compressing the garment secondarily seated in the secondary garment seating step between the stack plate and a movable plate in the unloading layer.

In addition, the garment compressing step may include: a garment compression preparing step of moving the unloading conveyor and the movable plate, which are on standby at a rear limit position after the garment is delivered to the stack plate in the secondary garment seating step, forward toward a predetermined target position; and a garment compression performing step of moving upward the stack plate which is on standby at a lower limit position after the unloading conveyor and the movable plate are moved to the predetermined target position in the garment compression preparing step.

In addition, the garment compression preparing step may include: a movable-plate-forward-movement step of moving the unloading conveyor and the movable plate, which are on standby at the rear limit position, toward the predetermined target position by supplying a current to a movable plate motor through a power conversion part; and a reach-to-target-position determining step of determining, after the movable-plate-forward-movement step, whether the movable plate has reached the predetermined target position by receiving an output signal from a movable plate position sensor that detects a position of the movable plate.

In addition, the garment compression preparing step may further include: a solution spraying step of stopping the movable plate by cutting of the supply of current to the movable plate motor through the power conversion part when it is determined in the reach-to-target-position determining step that the movable plate has reached the predetermined target position, and spraying a garment treatment solution toward the garment through a nozzle provided at a lower side of the movable plate.

In addition, the predetermined target position may be a front limit position at which the movable plate cannot move forward any further.

In addition, the garment compression performing step may include: a stack-plate-upward movement step of moving upward the stack plate, which is on standby at the lower limit position, by supplying a current to a stack plate motor through a power conversion part; a stack plate motor current value receiving step of receiving, through the power conversion part, a motor current value supplied to the stack plate motor in the stack-plate-upward movement step; a critical motor current value calculating step of calculating a critical motor current value based on a constant speed motor current value among the motor current values received in the stack plate motor current value receiving step; a stack plate motor operating time calculating step of calculating an operating time after the current is supplied to the stack plate motor in the stack-plate-upward movement step; and a current-value-and-operating-time determining step of determining whether a current motor current value supplied to the current stack plate motor exceeds the critical motor current value and whether the calculated operating time exceeds a predetermined critical operating time.

In addition, the critical motor current value may be calculated by multiplying a constant speed motor current value, which is supplied while the stack plate motor rotates at a constant speed among the motor current values received in the stack plate motor current value receiving step, by a predetermined safety factor.

In addition, the safety factor may be 1.3 to 1.5.

In addition, the predetermined critical operating time may be 1.5 seconds to 2.5 seconds.

The garment compression performing step may further include: a stack-plate-pressing stopping step of stopping the stack plate by cutting off the supply of current to the stack plate motor through the power conversion part when it is determined that the current motor current value is equal to or larger than the critical motor current value or it is determined that the calculated operating time is equal to or larger than the predetermined critical operating time in the current-value-and-operating-time determining step; and a stack-plate-downward-movement step of moving the stack plate downward by supplying a current to the stack plate motor through the power conversion part after the stack plate stopping step.

In addition, the garment compression performing step may further include: a reach-to-lower-limit-position determining step of determining, after the stack-plate-downward-movement step, whether the stack plate has reached the lower limit position by receiving an output signal from a stack plate position sensor provided at a lower side of the stack plate.

In addition, the garment compression performing step may further include: a stack plate stopping step of stopping the stack plate by cutting off the supply of current to the stack plate motor through the power conversion part when it is determined in the reach-to-lower-limit-position determining step that the stack plate has reached the lower limit position.

The method may further include: an unloading layer position initializing step of initializing, after the stack plate stopping step, a position of the unloading layer by moving the movable plate, which is on standby at the predetermined target position, to the rear limit position.

In addition, the unloading layer position initializing step may include: a movable-plate-rearward-movement step of moving rearward the movable plate, which is on standby at the predetermined target position, by supplying a current to the movable plate motor through the power conversion part; a reach-to-rear-limit-position determining step of determining whether the movable plate has reached the rear limit position by receiving an output signal from the movable plate position sensor after the movable plate moves rearward in the movable-plate-rearward-movement step; and a movable plate stopping step of stopping the movable plate by cutting off the supply of current to the movable plate motor through the power conversion part when it is determined in the reach-to-rear-limit-position determining step that the movable plate has reached the rear limit position.

The method of controlling the garment folding machine according to the present disclosure uses the stack plate provided to be movable in the upward/downward direction and compresses the folded garments after the folded garments are stacked, thereby improving stability of the stacked garments and increasing the number of garments that can be accommodated in the drawer.

In addition, the present disclosure may improve operational stability and reliability by avoiding an overload situation that may occur in the stack plate motor during the process of compressing the garments stacked by using the stack plate.

DETAILED DESCRIPTION

Figure 1:
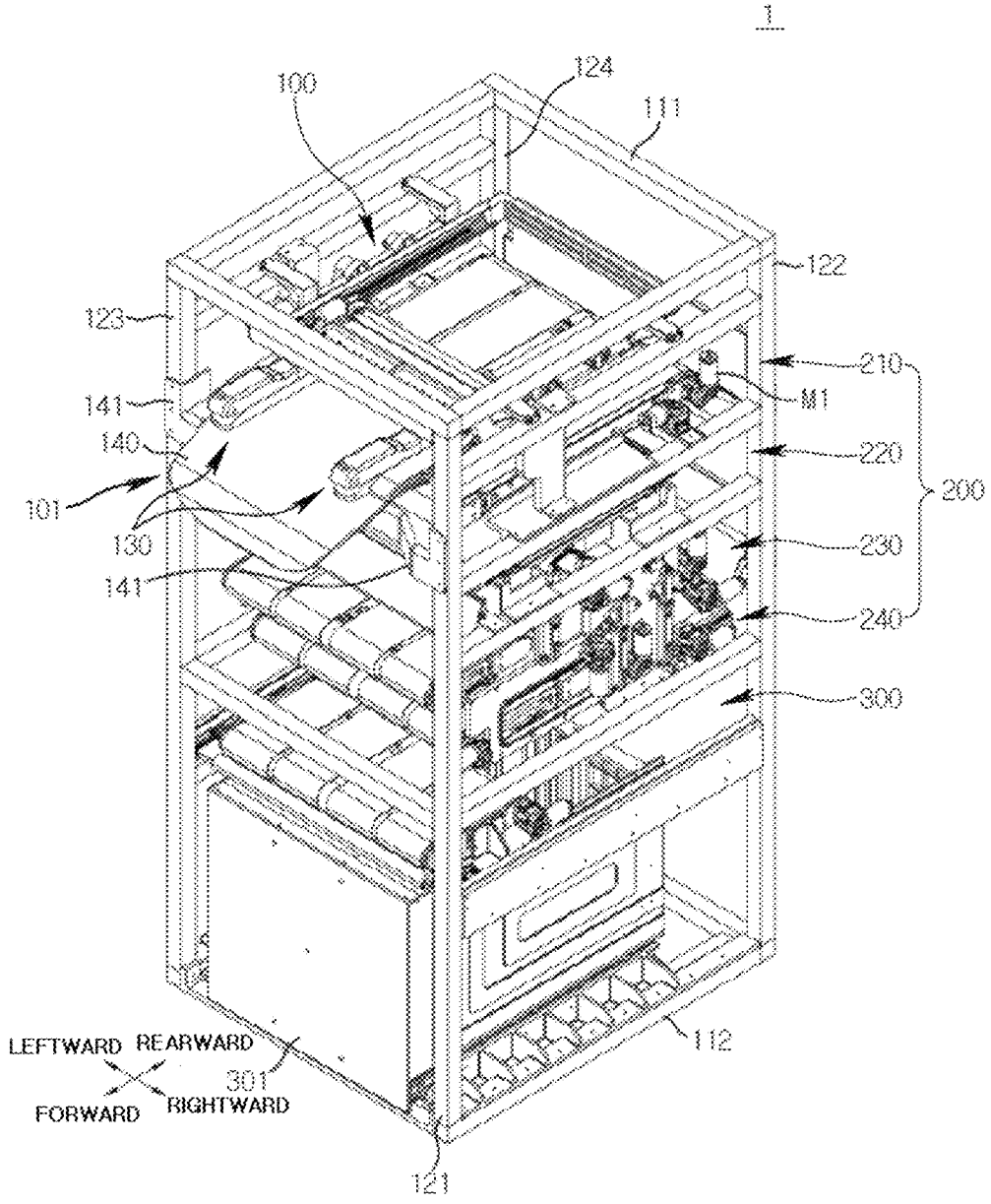
FIG. 1 is a schematic configuration view illustrating a basic configuration of a garment folding machine according to the present disclosure.

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

In the description of the present disclosure, the terms such as "first" and "second" may be used to describe various components, but the components should not be limited by the terms. These terms are used only to distinguish one component from another component. For example, a first component may be named a second component, and similarly, the second component may also be named the first component, without departing from the scope of the present disclosure.

The term "and/or" includes any and all combinations of a plurality of the related and listed items.

When one component is described as being "coupled" or "connected" to another component, it should be understood that one component can be coupled or connected directly to another component, and an intervening component can also be present between the components. When one component is described as being "coupled directly to" or "connected directly to" another component, it should be understood that no intervening component is present between the components.

The terms used herein is used for the purpose of describing particular embodiments only and is not intended to limit the present disclosure. Singular expressions include plural expressions unless clearly described as different meanings in the context.

The terms "comprises," "comprising," "includes," "including," "containing," "has," "having" or other variations thereof are inclusive and therefore specify the presence of stated features, integers, steps, operations, elements, and/or components, but do not preclude the presence or addition of one or more other features, integers, steps, operations, elements, components, and/or groups thereof.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Further, the following embodiments are provided to more completely explain the present disclosure to those skilled in the art, and shapes and sizes of elements illustrated in the drawings may be exaggerated for a more apparent description.

Hereinafter, a basic configuration of a garment folding machine 1 according to the present disclosure will be described with reference to FIGS. 1 to 3.

Figure 2:
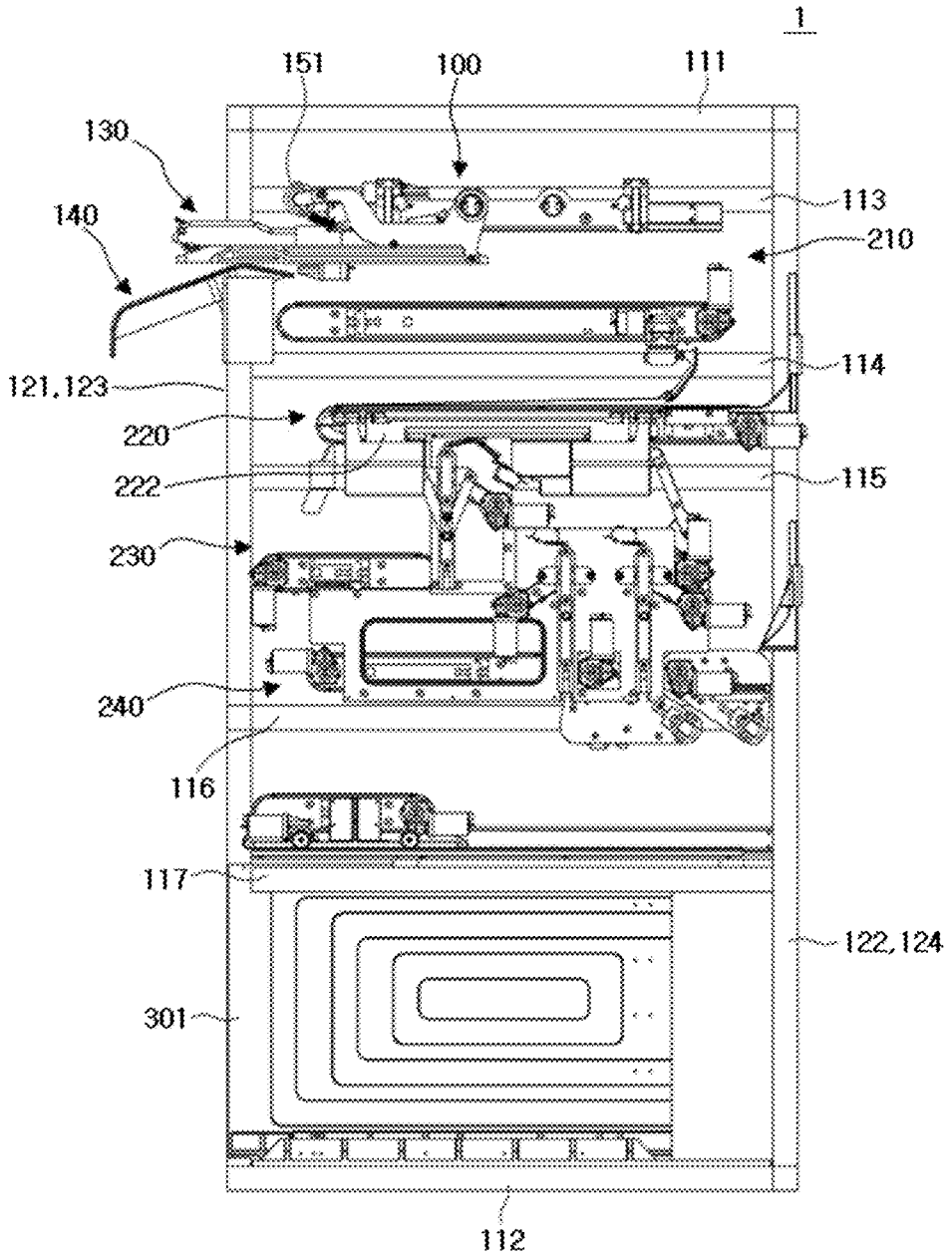
FIG. 2 is a side view of FIG. 1, that is, a schematic view illustrating a plurality of folding layers disposed as a layered structure.
Figure 3:
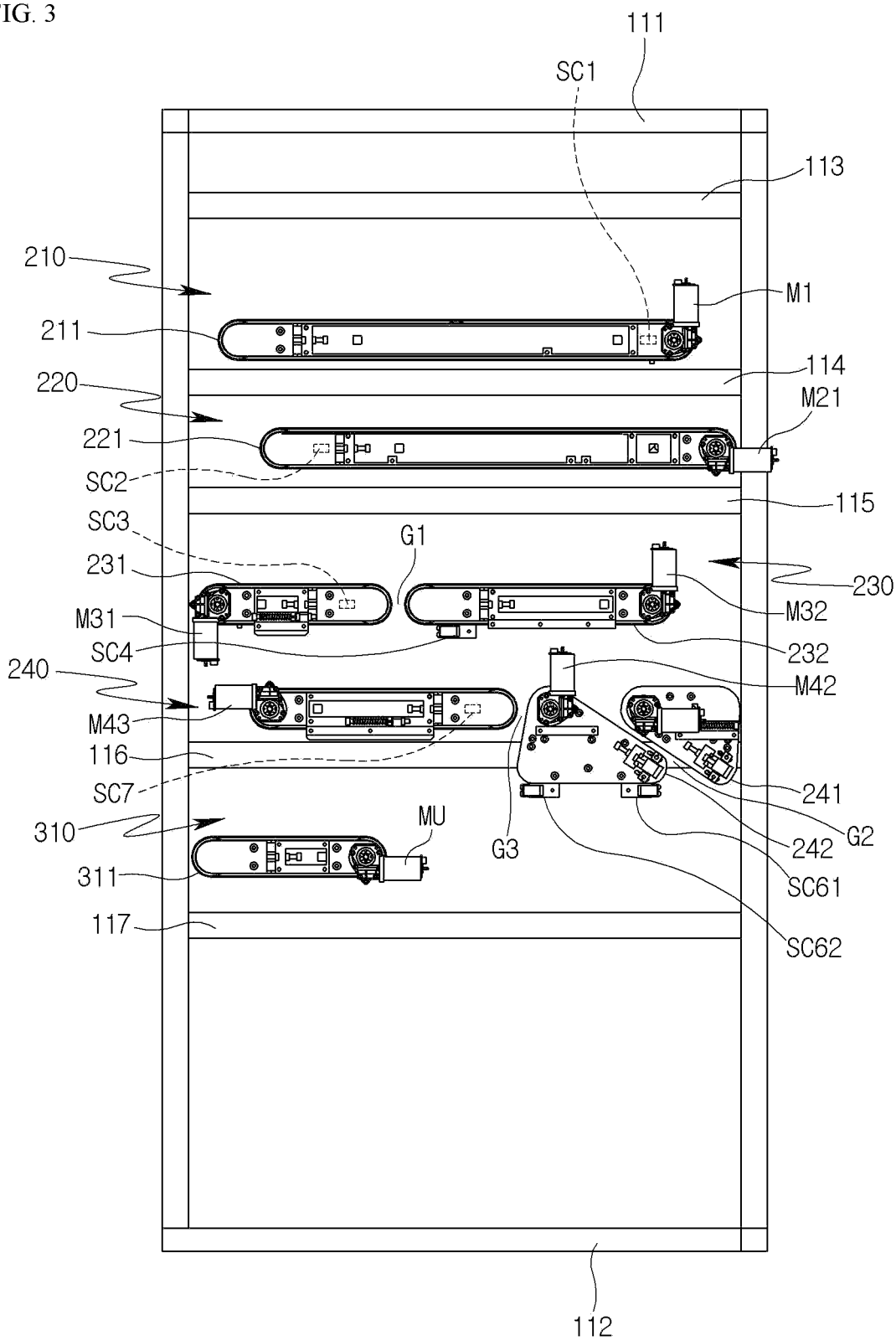
FIG. 3 is a schematic view illustrating conveyor structures of individual folding layers in the configuration illustrated in FIG. 2.

Referring to FIGS. 1 to 3, the garment folding machine 1 according to the present disclosure includes a frame unit that serves as an external framework.

The frame unit is disposed at an outer edge of the garment folding machine 1 and defines a minimum operating space in the garment folding machine 1. The frame unit may stably support several members constituting the garment folding machine 1.

In more detail, the frame unit includes an upper frame 111, a lower frame 112, a plurality of horizontal frames 113, 114, 115, 116, and 117, and a plurality of vertical frames 121, 122, 123, and 124.

The upper frame 111 is horizontally disposed at an upper end of the garment folding machine 1, and an upper operating space of the garment folding machine 1 may be defined by the upper frame 111.

The lower frame 112 may be horizontally disposed at a lower end of the garment folding machine 1 and may support the garment folding machine 1 on a floor. A lower operating space of the garment folding machine 1 may be defined by the lower frame 112.

The plurality of horizontal frames 113, 114, 115, 116, and 117 may be horizontally disposed between the upper frame 111 and the lower frame 112. A loading unit 100, a folding unit 200, and an unloading unit 300, which will be described below, may be mounted and supported on the plurality of horizontal frames 113, 114, 115, 116, and 117.

A space between the two horizontal frames may be defined as an operating space for an individual folding layer.

For example, an operating space for a second folding layer 220 (see FIGS. 2 and 3) for performing vertical folding may be defined by a second horizontal frame 114 and a third horizontal frame 115.

Meanwhile, the space between the two horizontal frames may also be defined as an operating space for the two folding layers.

For example, an operating space for the third folding layer 230 and the fourth folding layer 240 (see FIGS. 2 and 3) for performing horizontal folding may be defined by the third horizontal frame 115 and a fourth horizontal frame 116.

In addition, a first horizontal frame 113 disposed adjacent to the upper frame 111 may be provided to support a clip assembly 130 for holding and conveying a garment inputted into a loading part 101. A fifth horizontal frame 117 disposed adjacent to the lower frame 112 may be provided below a guide rail to support the guide rail that serves to allow an unloading conveyor 311 to be described below to slide in a forward/rearward direction.

Meanwhile, the vertical frames 121, 122, 123, and 124 include first and third vertical frames 121 and 123 disposed at a front side from which the garment is inputted, and second and fourth vertical frames 122 and 124 disposed to face the first and third vertical frames 121 and 123 and configured to define a rear operating space in the garment folding machine 1.

A finishing cover (not illustrated) may be stably attached to an outer peripheral side of the frame unit, and the finishing cover serves to define an external appearance of the garment folding machine 1 and protect the members disposed in the garment folding machine 1. In addition, an input unit (not illustrated), a display unit 600 (see FIG. 15), and an alarm unit 700 (see FIG. 15) may be provided on a front portion of the finishing cover, the input unit (not illustrated) is configured to receive a control instruction from a user, the display unit 600 is configured to visually provide the user with information on operating states of the garment folding machine 1, and the alarm unit 700 is configured to aurally provide the user with information on the operating states of the garment folding machine 1.

Since the frame unit is provided as described above, a vertical folding assembly 222 and horizontal folding assemblies are supported at the same time so that the functions of conveying and folding the garment are smoothly performed by respective folding layers 210, 220, 230, and 240 of the folding unit 200 to be described below, such that a required space may be saved and an overall volume of the garment folding machine 1 may be reduced.

Meanwhile, the garment folding machine 1 may include the loading unit 100, the folding unit 200, and the unloading unit 300.

The loading unit 100, the folding unit 200, and the unloading unit 300 may be supported on the frame unit, and an operating space for the loading unit 100, an operating space for the folding unit 200, and an operating space for the unloading unit 300 may be defined by the frame unit.

For example, the operating space of the loading unit 100 may be defined by the upper frame 111 and the second horizontal frame 114, and the operating space of the unloading unit 300 may be defined by the fourth horizontal frame 116 and the lower frame 112.

The loading unit 100 serves to load the garment. The loading unit 100 serves to load the garment, which is inputted to the loading part 101, at a predetermined position on an upper surface of a first conveyor 211 of the first folding layer 210.

In this case, the garments not only mean upper garments or lower garments manufactured using natural fibers or synthetic fibers so as to be worn by persons, but also include all products such as towels or bedclothes that may be provided by being folded to have desired sizes and thicknesses by the garment folding machine 1.

As an example, the loading unit 100 includes the clip assembly 130 (see FIGS. 1 and 2) that holds the garment inputted by the loading part 101.

FIGS. 1 and 2 illustrate the clip assembly 130 configured to hold the garment at two points. For convenience, the clip assembly 130 configured to hold the garment at the two points will be described, but the present disclosure is not limited thereto.

When the garment is completely held at a first position corresponding to an initial position, the clip assembly 130 draws the garment into the garment folding machine 1 and moves the garment to a second position corresponding to a loading position on the upper surface of the first conveyor 211 while holding the garment and moving rearward by a predetermined distance. When the clip assembly 130 completely moves to the second position, the clip assembly 130 releases the garment.

In addition, after the clip assembly 130 releases the garment, the clip assembly 130 additionally moves to a third position, that is, a position disposed further rearward from the second position. When the clip assembly 130 reaches the third position, the first conveyor 211 of the first folding layer 210 begins to operate.

The loading unit 100 includes a loading unit motor (not illustrated) configured to generate power for moving the clip assembly 130 in the forward/rearward direction. As an example, the loading unit motor has a pinion gear fixed to the clip assembly 130 and connected to an output shaft of the loading unit motor, and the pinion gear meshes with a rectilinear gear fixed to a frame of the loading unit 100, such that rotational power of the loading unit motor may be converted into a force for rectilinear motion in the forward/rearward direction.

The folding unit 200 serves to convey and fold the garment loaded by the loading unit 100.

In more detail, as illustrated in FIGS. 2 and 3, the folding unit 200 includes the four or more folding layers 210, 220, 230, and 240 so that the loaded garment is conveyed and folded to an appropriate size and shape. The four or more folding layers 210, 220, 230, and 240 are disposed to be spaced apart from one another in the upward/downward direction.

The loaded garment is folded one or more times finally while being conveyed from the folding layer at the upper side to the folding layer at the lower side, and the garments, which are completely folded to appropriate sizes and shapes, are collected in a drawer 301.

The four folding layers 210, 220, 230, and 240 are disposed to be spaced apart from one another in the upward/downward direction and serve to allow the loaded garment to be folded to an appropriate size and shape while being conveyed from the first folding layer 210 at the uppermost side to the fourth folding layer 240 at the lowermost side.

The unloading unit 300 is disposed below the fourth folding layer 240 at the lowermost side.

As illustrated in FIGS. 2 and 3, an unloading layer 310 is disposed below the fourth folding layer 240, and the completely folded garment is dropped and primarily seated in the unloading layer 310.

In addition, the drawer 301 having a stack module 320 therein is disposed below the unloading layer 310, and the primarily seated garments are secondarily seated in a stack module 320 and uniformly collected.

A detailed configuration related to the unloading unit 300 will be described below with reference to FIG. 4 and the following drawings.

Meanwhile, each of the folding layers 210, 220, 230, and 240 includes at least one conveyor 211, 221, 231, 241, 242, or 243. The conveyors 211, 221, 231, 241, 242, and 243 serve to convey or horizontally fold the loaded garment.

In more detail, in the embodiment illustrated in FIGS. 2 and 3, the first folding layer 210 includes a first conveyor 211 configured to convey the loaded garment, and a first conveyor motor M1 configured to operate the first conveyor 211.

In addition, the second folding layer 220 includes a second conveyor 221 and a second conveyor motor M21 configured to operate the second conveyor 221.

Meanwhile, the third folding layer 230 may include a third conveyor 231 and a fourth conveyor 232 spaced apart from each other at a predetermined interval, and a third conveyor motor M31 and a fourth conveyor motor M32 configured to operate the third conveyor 231 and the fourth conveyor 232, respectively.

As illustrated, the third conveyor 231 is disposed at the front side of the garment folding machine 1, the fourth conveyor 232 is disposed at the rear side of the garment folding machine 1, and an upper surface of the third conveyor 231 and an upper surface of the fourth conveyor are disposed approximately side by side.

Meanwhile, the predetermined interval defined between the third conveyor 231 and the fourth conveyor 232 of the third folding layer 230 is a first folding gap G1 that serves to allow the garment to pass through the first folding gap G1 while being horizontally folded.

In addition, the fourth folding layer 240 includes a fifth conveyor 241, a sixth conveyor 242, and a seventh conveyor 243 disposed sequentially from the rear side to the front side of the garment folding machine 1, and a fifth conveyor motor M41, a sixth conveyor motor M42, and a seventh conveyor motor M43 configured to operate the fifth conveyor 241, the sixth conveyor 242, and the seventh conveyor 243.

Two folding gaps G2 and G3 may be defined between the fifth conveyor 241, the sixth conveyor 242, and the seventh conveyor 243 provided in the fourth folding layer 240 so that the garment may be horizontally folded or may pass through the two folding gaps G2 and G1 while being horizontally folded.

In this case, the horizontal folding means that the garment is folded about a reference line perpendicular to a proceeding direction of the garment. The direction perpendicular to the proceeding direction of the garment is not limited to a configuration in which a line in the proceeding direction of the garment and a folding line are perfectly disposed at 90 degrees, but the direction perpendicular to the proceeding direction of the garment includes a configuration in which the line in the proceeding direction of the garment and the folding line are disposed within an error range of 0 degree to 30 degrees.

In addition, as illustrated in FIG. 3, garment detection sensors may be disposed in the first to fourth folding layers 210, 220, 230, and 240 and provided to check whether the conveyed garment reaches the first to fourth folding layers 210, 220, 230, and 240 or whether the garment passes through the first to fourth folding layers 210, 220, 230, and 240.

In more detail, a first-conveyor-rear-end garment detection sensor SC1 is provided at a rear end of the first conveyor 211 to detect whether the garment C reaches the first conveyor 211.

The first-conveyor-rear-end garment detection sensor SC1 serves only to detect whether the garment C is present in an effective detection range. The first-conveyor-rear-end garment detection sensor SC1 is a digital sensor that outputs an ON-signal when the garment C is present in the effective detection range, and outputs an OFF-signal when the garment C is not present in the effective detection range.

In addition, a second-conveyor-front-end garment detection sensor SC2 may be provided at a front end of the second conveyor 221, a third-conveyor-rear-end garment detection sensor SC3 may be provided at a rear end of the third conveyor 231, and a fourth-conveyor-lower-part garment detection sensor SC4 may be provided at a lower side of the fourth conveyor 232 so that the sensors may perform the same function in the same way as the first-conveyor-rear-end garment detection sensor SC1.

In addition, in the fourth folding layer 240, a sixth-conveyor-rear-lower-part garment detection sensor SC61 and a sixth-conveyor-front-lower-part garment detection sensor SC62 may be provided at a rear lower side and a front lower side of the sixth conveyor 242, respectively, and a seventh-conveyor-rear-end garment detection sensor SC7 may be provided at a rear end of the seventh conveyor.

Meanwhile, the folding unit 200 is configured to perform the vertical folding function that serves to vertically fold the loaded garment.

In the embodiment illustrated in FIG. 2, the first folding layer 210 and the second folding layer 220, which are the two upper folding layers among the four folding layers constituting the folding unit 200, are configured to vertically fold the garment.

In this case, the vertical folding means that the garment is folded about a reference line parallel to the proceeding direction of the garment. The direction parallel to the proceeding direction of the garment is not limited to a configuration in which the line in the proceeding direction of the garment and the folding line are perfectly disposed at 0 degree, but the direction parallel to the proceeding direction of the garment includes a configuration in which the line in the proceeding direction of the garment and the folding line are disposed within an error range of 0 degree to 30 degrees.

First, the first folding layer 210 may serve to vertically fold the garment loaded from the loading unit 100 while conveying the garment to a rear end thereof. In particular, the first folding layer 210 may vertically fold a sleeve portion of an upper garment that needs to be vertically folded.

Specifically, in a state in which the sleeve portion of the upper garment is folded to a predetermined degree by a seating plate 140 (see FIG. 1) provided in the loading part 101 of the loading unit 100 and by a primary vertical folding guide 141 provided at a lower side of the seating plate 140, the garment may be loaded onto the first conveyor 211 while being pulled by the clip assembly 130 and vertically folded primarily and manually.

As described above, the loading by the loading unit 100 and the vertical folding are performed at the same time in the first folding layer 210, such that the folding process may be simplified and the size of the machine may be reduced.

Meanwhile, the second folding layer 220 may be provided with a vertical folding assembly 222 in order to vertically fold the garment C conveyed from the first folding layer 210.

The vertical folding assembly 222 may be configured as an active assembly having a mechanism that actively and vertically folds the garment C by receiving a force from a vertical folding motor (not illustrated) which is a driving source.

As an example, the vertical folding assembly 222 may include vertical folding plates (not illustrated) configured such that a position thereof is changed by the force from the vertical folding motor.

The pair of vertical folding plates having approximately the same shape may be provided, and the second conveyor 221 is disposed between the pair of vertical folding plates.

The vertical folding plates are on standby on the same plane as an upper surface of the second conveyor at the initial position. In order to vertically fold the garment delivered from the first conveyor 211 and deployed on the second conveyor 221 and the vertical folding plates, the pair of vertical folding plates lifts up two opposite portions of the garment and moving the two opposite portions of the garment toward the inside of the garment, thereby vertically folding the garment.

The vertical folding assembly may further include plate position sensors (not illustrated) capable of detecting an initial position and a vertical folding completion position of the vertical folding plates.

As described above, the unloading unit 300 is provided to collect and discharge the garments folded by passing through the folding unit 200.

A detailed configuration of the unloading unit 300 according to the present disclosure will be described below with reference to FIGS. 4 to 6.

First, the unloading unit 300 includes the unloading layer 310 in which the garment C dropped from the fourth folding layer 240 is primarily seated.

Figure 4:
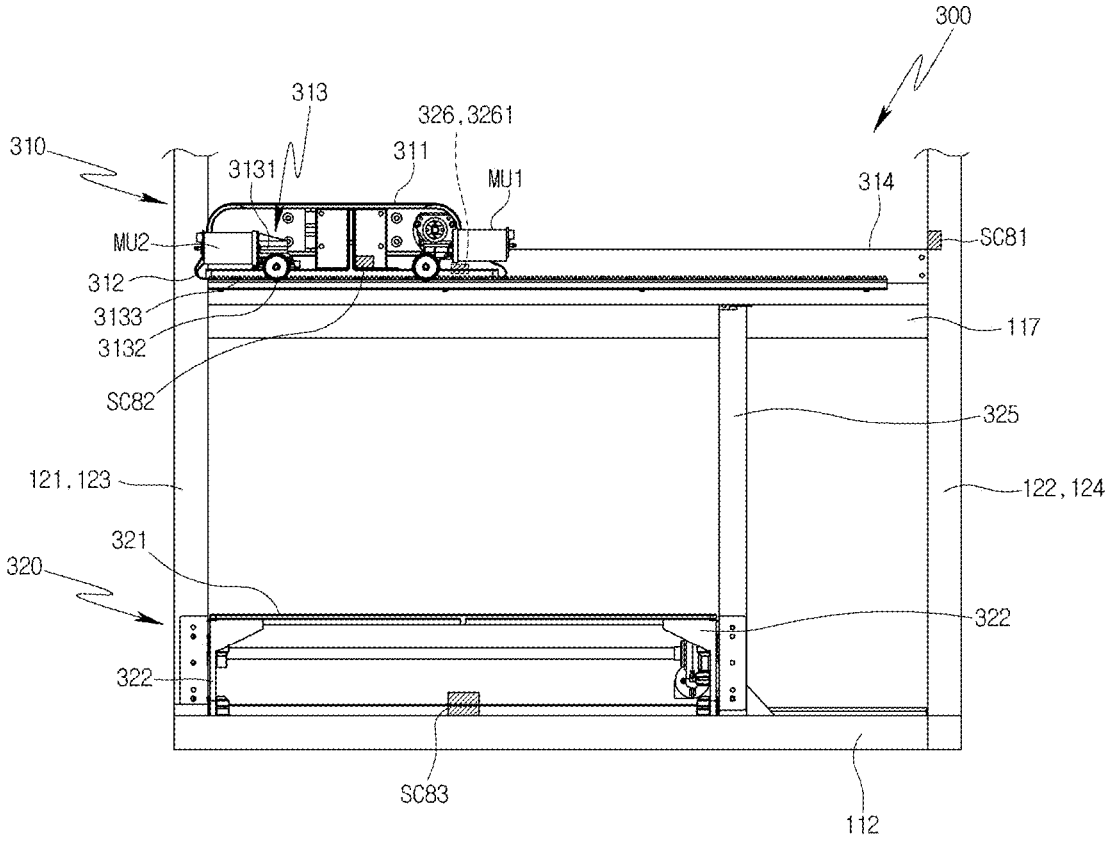
FIG. 4 is a schematic view illustrating a structure of an unloading unit among the components illustrated in FIG. 2.
Figure 5:
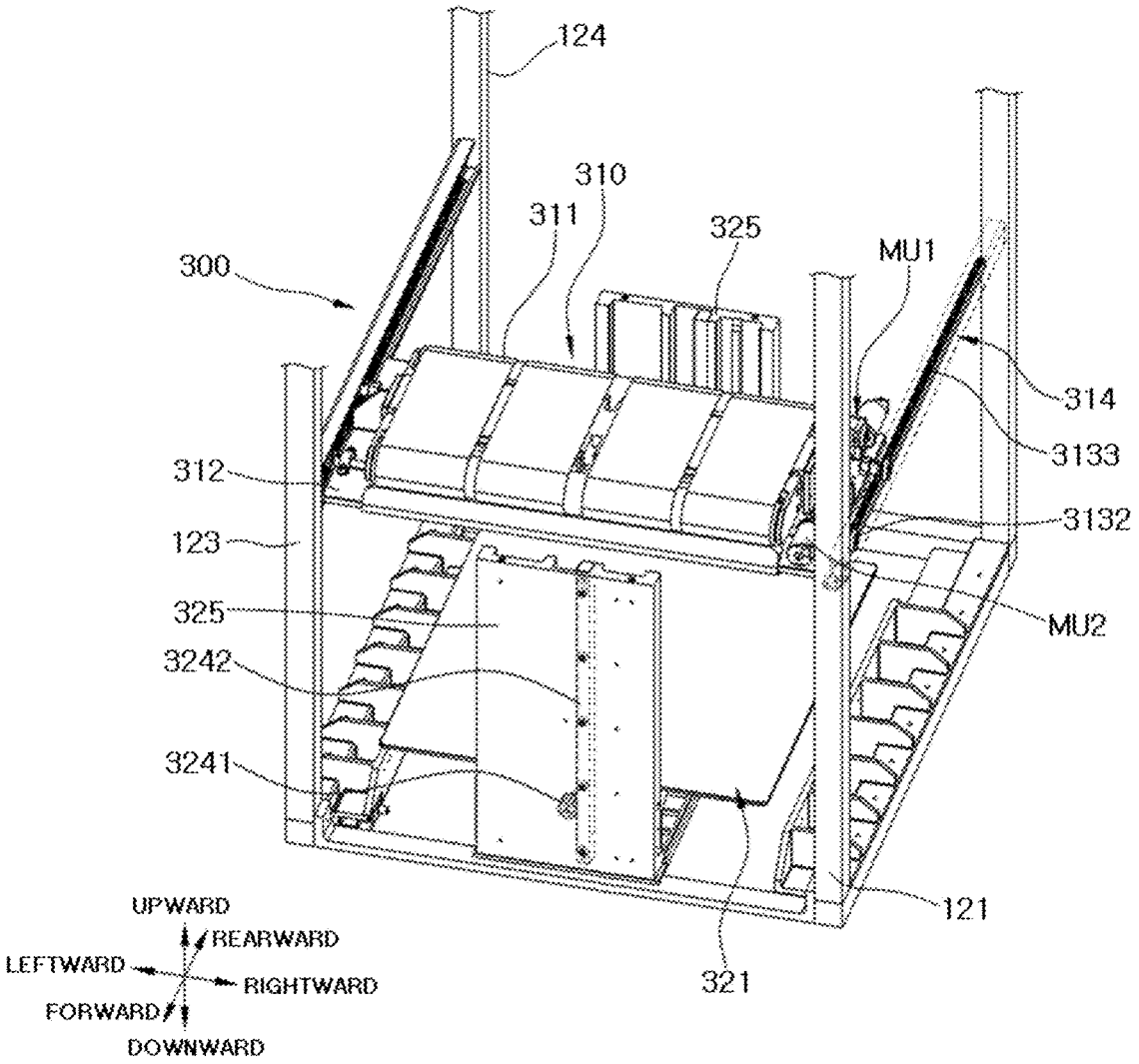
FIG. 5 is a perspective side view of FIG. 4.

As illustrated in FIGS. 4 and 5, the unloading layer 310 includes an unloading conveyor 311 having an upper surface on which the garment C dropped from the fourth folding layer 240 is seated, and an unloading conveyor motor MU1 configured to operate the unloading conveyor 311.

Meanwhile, the unloading layer 310 further includes a movable plate 312 configured to support the unloading conveyor 311 and the unloading conveyor motor MU1 so that the unloading conveyor 311 and the unloading conveyor motor MU1 are movable in the forward/rearward direction, and a movable plate motor MU2 configured to generate driving power for moving the movable plate 312 in the forward/rearward direction.

That is, in a state in which the unloading conveyor 311 and the unloading conveyor motor MU1 are supported on an upper surface of the movable plate 312, the unloading conveyor 311 and the unloading conveyor motor MU1 rectilinearly reciprocate between a front limit position and a rear limit position during a process of receiving the garment C from the fourth folding layer 240 and a process of deliver the garment C to the stack module 320.

The unloading layer 310 may further include a motion conversion part 313 for converting a rotational force of the movable plate motor MU2 into a forward/rearward rectilinear reciprocating force.

As an example, FIGS. 3 and 4 illustrate an embodiment in which the motion conversion part 313 includes a worm 3131 connected directly to an output shaft of the movable plate motor MU2, a worm gear 3132 configured to receive a rotational force from the worm 3131, and a gear 3133 configured to mesh with the worm gear 3132 and having a rack extending in the forward/rearward direction.

Therefore, when the current is supplied to the movable plate motor MU2 to operate the movable plate 312, the worm 3131 is rotated, and the rotational force of the worm 3131 is transmitted to the worm gear 3132. Since the worm gear 3132 meshes with the rectilinear rack gear 3133, the rotational force of the worm 3131 is finally converted into driving power when the worm gear 3132 is rotated, and the driving power rectilinearly reciprocates the movable plate 312 in the forward/rearward direction.

The embodiment in which the motion conversion part 313 of the movable plate 312 includes the worm 3131, the worm gear 3132, and the rack gear 3133 will be described, but the present disclosure is not limited thereto.

The rack gear 3133 of the unloading layer 310 serves to convert the rotational force of the movable plate motor MU2 into the rectilinear reciprocating force and also serves to support the movable plate 312 and the unloading conveyor 311 in a gravitational direction. Therefore, the rack gear 3133 may be configured to be supported on the fifth horizontal frame 117 or supported by a rail guide 314 provided in the form of a frame.

For example, FIG. 4 and the following drawings illustrate the embodiment in which the rack gear 3133 of the unloading layer 310 is supported by the separate rail guide 314. The embodiment in which the rack gear 3133 of the unloading layer 310 is supported by the rail guide 314 will be described, but the present disclosure is not limited thereto.

Meanwhile, the unloading layer 310 further includes a movable plate position sensor SC81 configured to detect a forward/rearward position of the movable plate 312, and a movable-plate-lower-part detection sensor SC82 provided at a lower side of the movable plate 312.

The movable plate position sensor SC81 is a sensor that serves to detect a current position of the movable plate 312 by measuring a relative distance from the movable plate 312. FIG. 4 illustrates an embodiment in which the movable plate position sensor SC81 is disposed on the second vertical frame 122 or the fourth vertical frame 124, but the embodiment is provided for illustration only, and the movable plate position sensor SC81 may be installed at any position without limitation as long as the movable plate position sensor SC81 may accurately detect the position of the movable plate 312.

The movable-plate-lower-part detection sensor SC82 serves to measure a distance from the stack plate 321 disposed below the movable plate 312 or a distance from an upper surface of the garment C in the state in which the garments C are stacked on the stack plate 321.

As illustrated, the movable-plate-lower-part detection sensor SC82 is provided on a lower surface of the movable plate 312.

As described below, an upward/downward position of the stack plate 321 may be accurately controlled by means of the movable-plate-lower-part detection sensor SC82 during the process of delivering the garment C from the unloading conveyor 311 to the stack plate 321.

A TOF (time of flight) sensor may be used for the movable plate position sensor SC81 and the movable-plate-lower-part detection sensor SC82, and this sensor is described for illustration only, and any means well known in the art may be applied as long as this means may measure a distance from an object to be detected.

In addition, a spray module 326 including a spray nozzle 3261 may be provided on the lower surface of the movable plate 312 and may spray a garment treatment solution to the garment C in the state in which the garments C are stacked on the stack plate 321.

Meanwhile, the unloading unit 300 includes the stack module 320 that receives the garment C primarily seated on the unloading conveyor 311 of the unloading layer 310 and secondarily seats the garment C.

Figure 6:
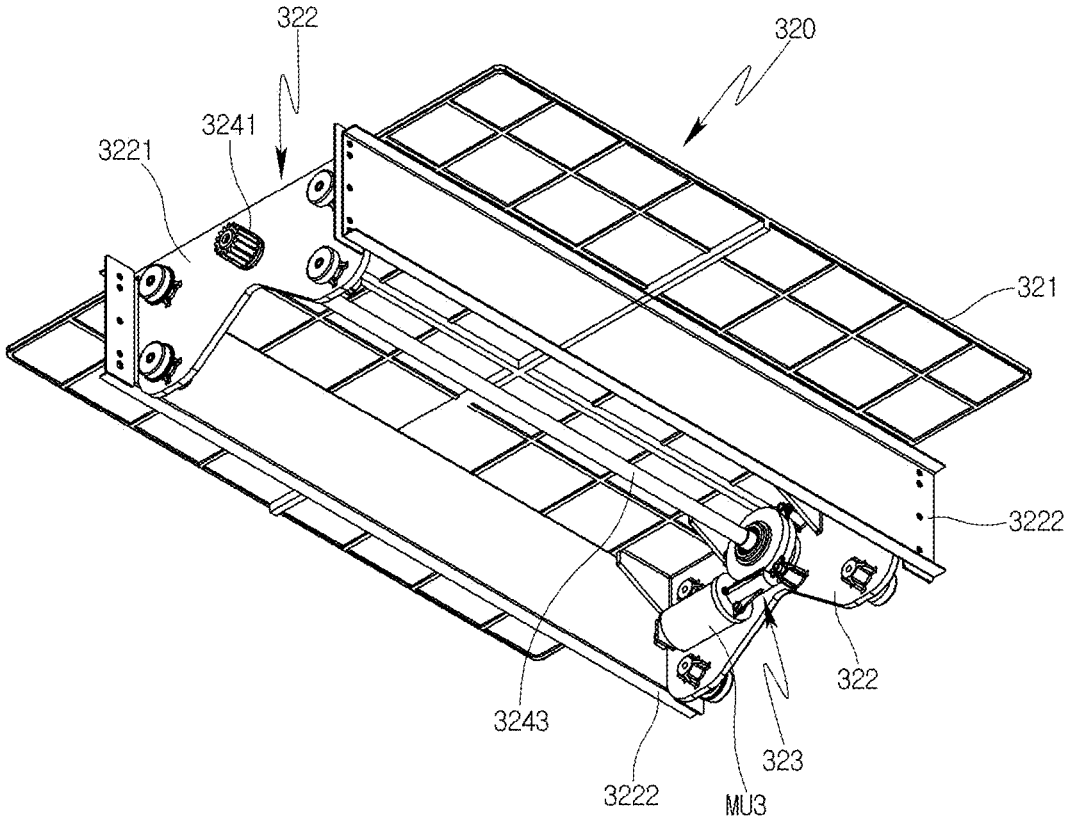
FIG. 6 is a bottom perspective view for explaining a stack module among the components illustrated in FIG. 4.

As illustrated in FIGS. 5 and 6, the stack module 320 includes the flat-plate-shaped stack plate 321 on which the garments C are stacked, a support bracket 322 disposed on a lower surface of the stack plate 321 and configured to support the stack plate 321, and a stack plate motor MU3 configured to generate driving power for moving the stack plate 321 in the upward/downward direction.

The stack plate 321 is configured as a board having an approximately flat plate shape so that the garments C may be stacked on the upper surface of the stack plate 321. The stack plate 321 is provided to be movable in the upward/downward direction in order to receive the garment C from the unloading layer 310 and compress the garments C in the state in which the garments C are stacked.

Since the stack plate 321 is moved in the upward/downward direction in the state in which a predetermined number of garments C are stacked on the stack plate 321, the stack plate 321 may be made of a plastic material which is lightweight and has predetermined rigidity.

The support bracket 322 is disposed on the lower surface of the stack plate 321 and serves to support the stack plate 321. In more detail, the support bracket 322 includes a pair of first brackets 3221 disposed at the front and rear sides so as to face each other, and a pair of second brackets 3222 disposed at the left and right sides so as to face each other.

As illustrated, the first bracket 3221 serves to support the front and rear portions of the stack plate 321 and also serves to support the stack plate motor MU3 for generating driving power for moving the stack plate 321 in the upward/downward direction and support a speed reduction mechanism 323 for reducing a rotational force of the stack plate motor MU3.

Similar to the above-mentioned unloading layer 310, the speed reduction mechanism 323 may include a worm connected directly to an output shaft of the stack plate motor MU3, and a worm gear configured to receive a rotational force from the worm.

The rotational force, which is reduced by the speed reduction mechanism 323 and transmitted from the speed reduction mechanism 323, is converted into a rectilinear reciprocating force by a motion conversion part. As an example, the motion conversion part includes a pair of pinion gears 3241 provided coaxially with a worm gear, and rectilinear rack gears 3242 configured to mesh with the pair of pinion gears 3241.

As illustrated, the worm gear and the pair of pinion gears 3241 may be connected with a shaft 3243 so that the rotational force may be transmitted from the worm gear to the pair of pinion gears 3241 at the same time.

As illustrated in FIG. 5, the rack gears 3242 are provided on guide brackets 325 disposed at the front and rear sides of the stack plate 321, respectively, and the rack gears 3242 extend in the upward/downward direction.

When the current is supplied to the stack plate motor MU3 through the speed reduction mechanism 323 and the motion conversion part, the rotational force of the stack plate motor MU3 is converted into the force for rectilinearly reciprocating the stack plate 321 in the upward/downward direction.

Meanwhile, as illustrated in FIG. 4, a stack plate position sensor SC83 is provided at a lower side of the stack module 320 and detects an upward/downward position of the stack plate 321.

The stack plate position sensor SC83 is a sensor serves to measure a relative distance from the stack plate 321 and detect the current position of the stack plate 321, particularly, detect whether the stack plate 321 reaches a lower limit position. Similar to the movable plate position sensor SC81 and the movable-plate-lower-part detection sensor SC82, the TOF sensor may be adopted as the stack plate position sensor SC83.

As described below, when the stack plate position sensor SC83 detects that the stack plate 321 reaches the lower limit position, the supply of current to the stack plate motor MU3 is cut off, such that the stack plate 321 is stopped at the lower limit position.

Meanwhile, as described above, the object of the present disclosure is to provide a means capable of compressing the garments C after the garments C are stacked on the stack plate 321, thereby improving stability of the stacked garments and increasing the number of garments C that can be accommodated in the drawer 301.

Hereinafter, a process of primarily seating the garment C in the unloading layer 310, a process of secondarily seating the garment C in the stack module 320, and a process of compressing the garment according to the present disclosure will be described with reference to FIGS. 7 to 14.

Figure 7:
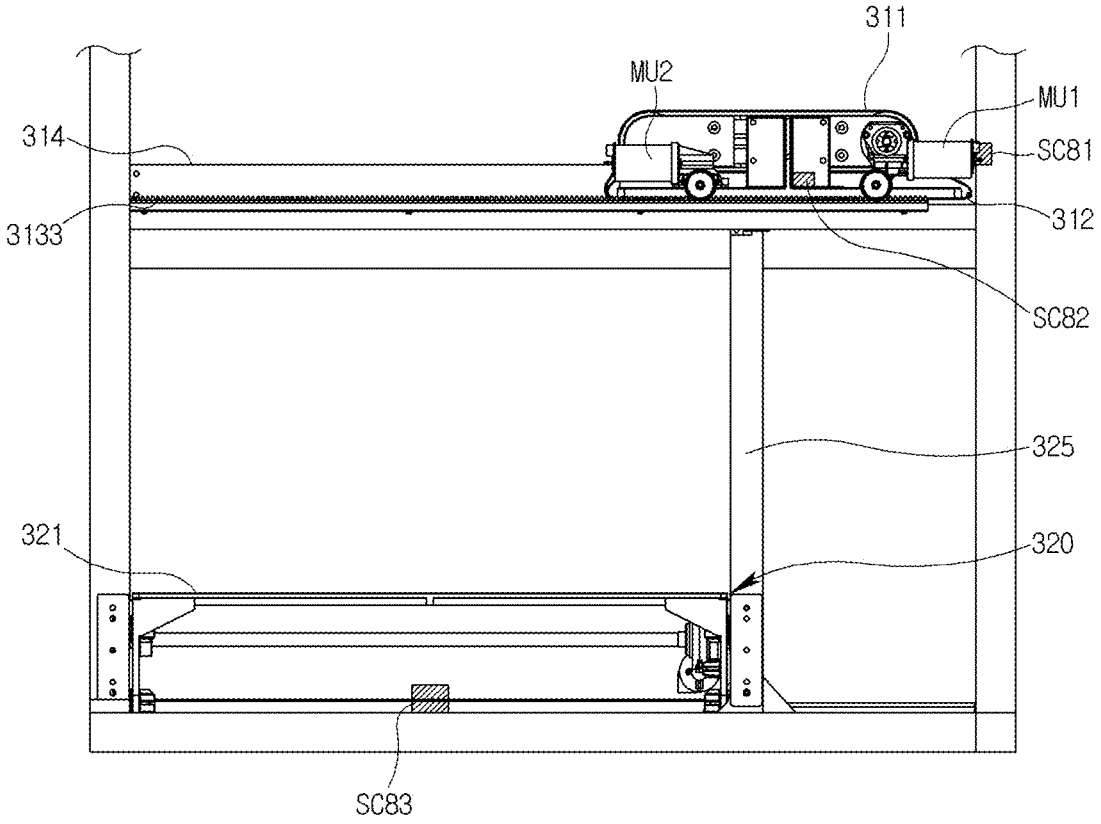
FIGS. 7 to 14 are schematic views for explaining a primary garment seating process, a secondary garment seating process, and a garment compressing process according to the present disclosure.
Figure 8:
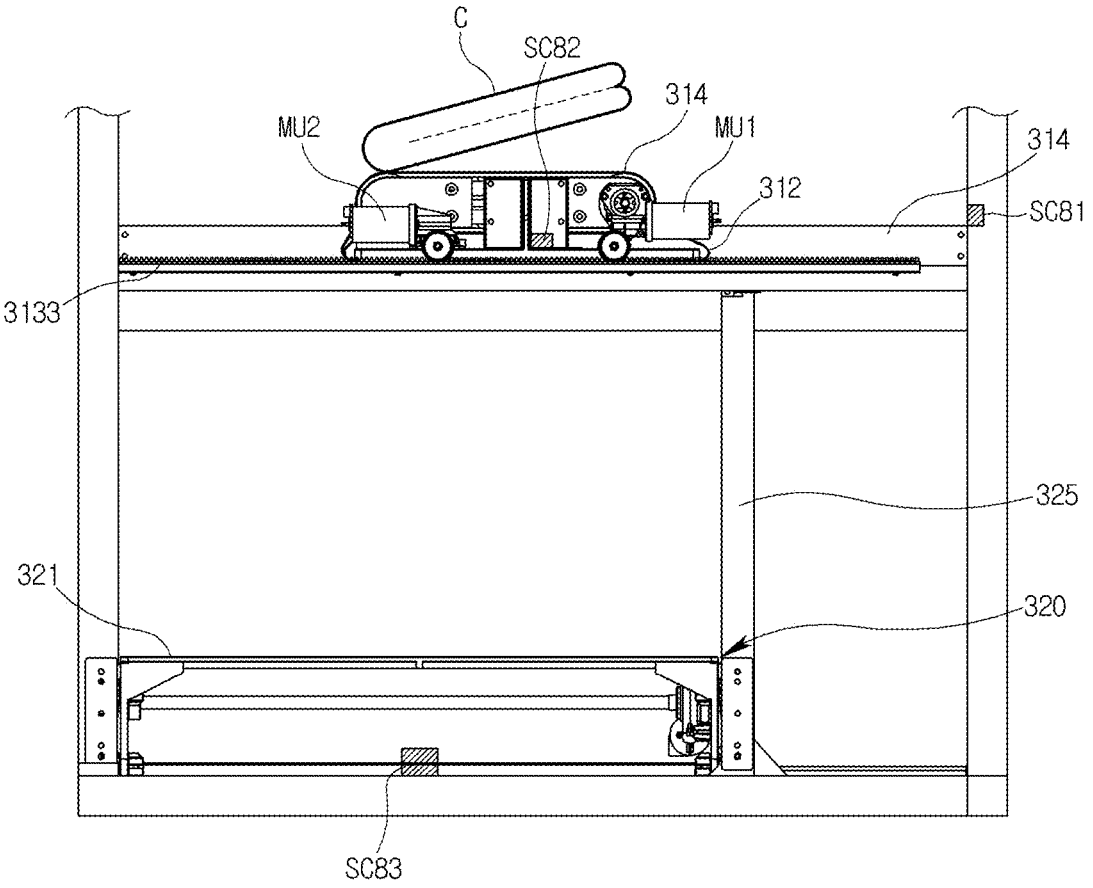

FIG. 7 illustrates a state in which the movable plate 312 and the stack module 320 are on standby in a state in which there is no garment C stacked in advance on the stack plate 321 of the stack module 320. The following processes may be equally applied even in a state in which there is the garment C is stacked in advance on the stack plate 321. For convenience, the processes, which are performed in the state in which there is no garment C stacked in advance on the stack plate 321, will be described.

First, referring to FIG. 7, before the processes of delivering the garment from the fourth folding layer and seating the garment are initiated, the unloading conveyor 311 and the movable plate 312 of the unloading layer 310 are stationary and on standby at the rear limit position.

In addition, in this case, the stack module 320 is stationary and on standby at the lower limit position.

Meanwhile, when the garments C begin to be delivered from the fourth folding layer, the current is supplied to the movable plate motor MU2, such that the movable plate 312 operates and moves forward.

In this case, the current is supplied to the movable plate motor MU2 at the timing preset based on an output signal received from the sensor such as the garment detection sensor SC62 in the fourth folding layer, such that the tip portion of the garment C delivered from the fourth folding layer may be controlled and dropped at the front end of the unloading conveyor 311.

As described above, when the garments C begin to be dropped from the fourth folding layer, the movable plate 312 continuously moves forward toward the front limit position, such that the garment C is primarily seated on the upper surface of the unloading conveyor 311.

In this case, in order to prevent the garment C to be seated from being wrinkled, a movement speed of the movable plate 312 may be maintained to be almost equal to a speed of delivery of the garment C.

Meanwhile, the unloading conveyor 311 is kept stationary while the garment C is seated on the unloading conveyor 311, and the stack module 320 is also kept stationary and on standby at the lower limit position.

Thereafter, when the process of primarily seating the garment C on the unloading conveyor 311 is completed, the movable plate 312 is moved to the front limit position. When it is determined, by the movable plate position sensor SC81, that the movable plate 312 has reached the front limit position, the supply of current to the movable plate motor MU2 is cut off, such that the movable plate 312 is stopped at the front limit position.

Figure 9:
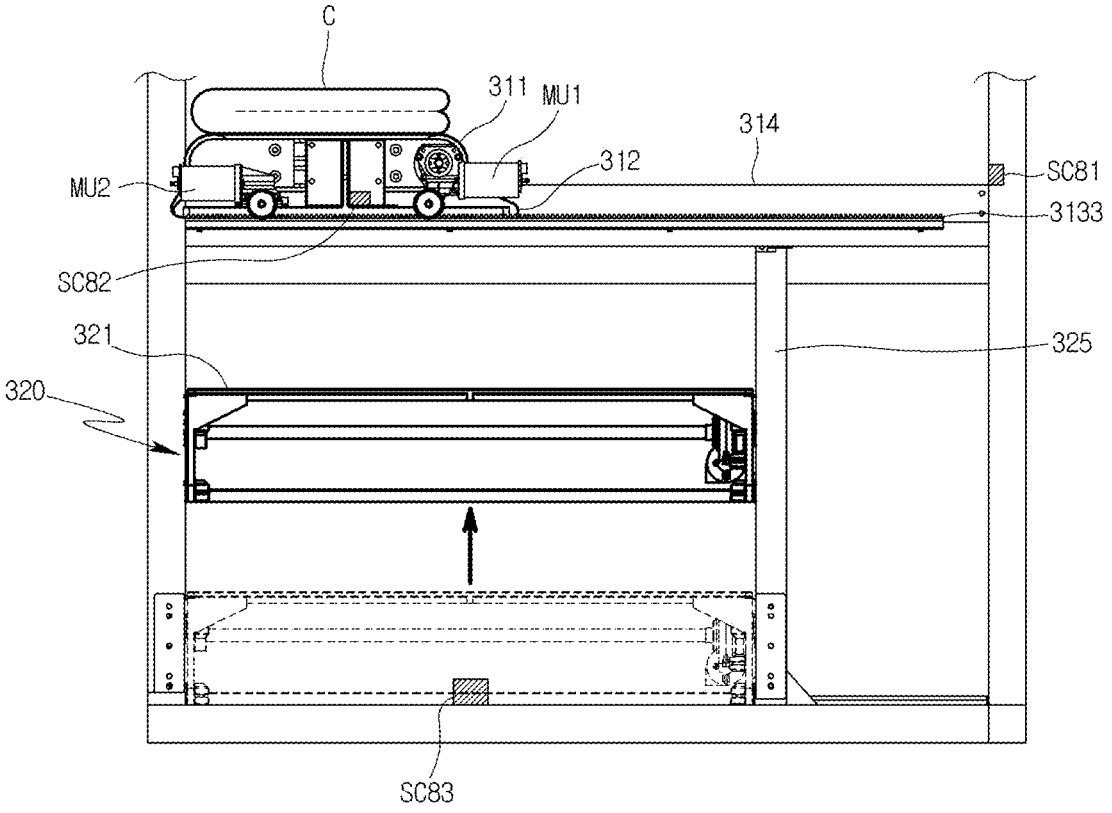

When the movable plate 312 is stopped at the front limit position, the current is supplied to the stack plate motor MU3, such that the stack plate 321, which is on standby at the lower limit position, is moved upward so that the garment C is secondarily seated, as illustrated in FIG. 9.

In this case, when it is determined, based on the output signal from the movable-plate-lower-part detection sensor SC82, that the position of the upper surface of the stack plate 321 or the position of the upper surface of the garment C, in the state in which the garments C are stacked on the stack plate 321, has reached an upper limit position, the supply of current to the stack plate motor MU3 is cut off, such that the stack plate 321 is stopped at the upper limit position.

In this case, the reason why the stack plate 321 is moved upward to the upper limit position is to minimize a difference in height between the stack plate 321 and the upper surface of the unloading conveyor 311 on which the garment C is primarily seated, thereby preventing the folded garment C from being unfolded during the process in which the garment C is dropped and secondarily seated.

Meanwhile, when the stack plate 321 is stopped at the upper limit position, in order to drop the garment C primarily seated on the upper surface of the unloading conveyor 311 and secondarily seat the garment C on the upper surface of the stack plate 321, the current is supplied to the movable plate motor MU2 so that the movable plate 312 operates rearward, and the current is supplied to the unloading conveyor motor MU1 so that the unloading conveyor 311 operates forward.

In this case, a point in time at which the current is supplied to the unloading conveyor motor MU1 and a point in time at which the current is supplied to the movable plate motor MU2 may be controlled to be equal to or different from each other.

That is, the point in time at which the current is supplied to the unloading conveyor motor MU1 may be adjusted depending on a size of the garment C and a position of the stack plate 321 at which the garment C is dropped, thereby adjusting a position at which the garment C begins to be dropped.

Figure 10:
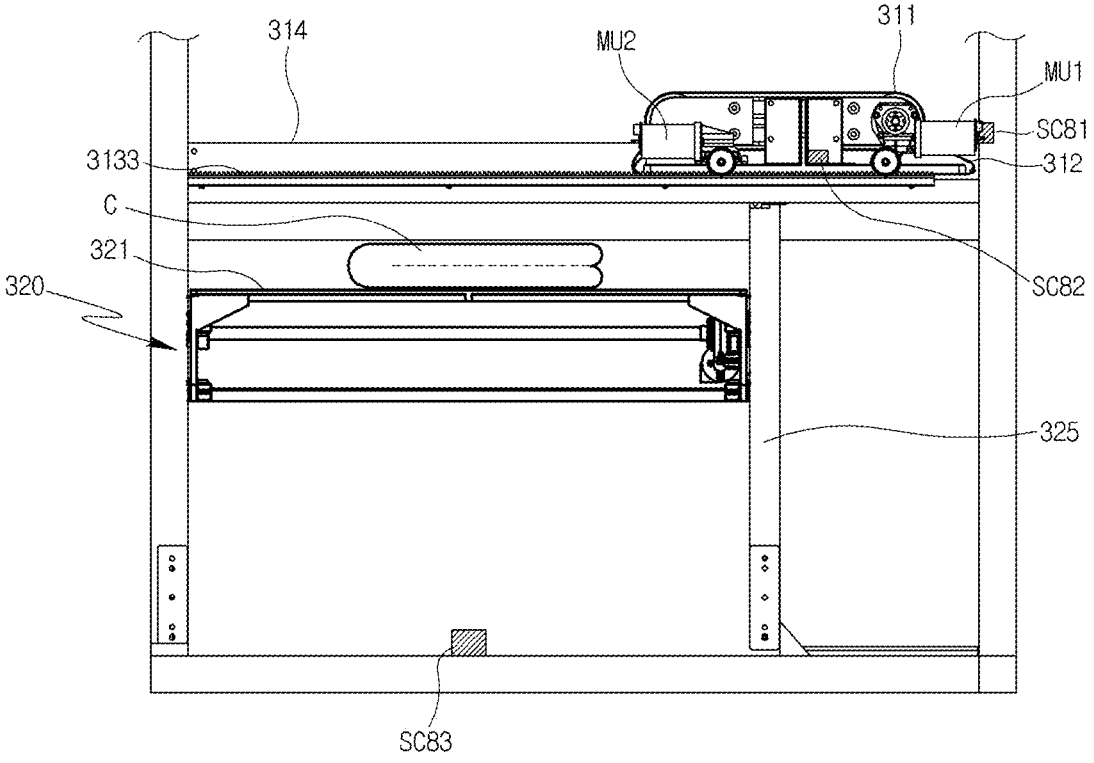

As an example, the current may be supplied to the conveyor motor after a predetermined time elapses from the point in time at which the current is supplied to the movable plate motor MU2, such that the garments C may be controlled and stacked at a center of the stack plate 321, as illustrated in FIG. 10.

Meanwhile, as illustrated in FIG. 10, after the garment C is secondarily seated on the upper surface of the stack plate 321, the current is continuously supplied to the movable plate motor MU2, such that the movable plate 312 is moved to the rear limit position.

When it is determined, based on the output signal from the movable plate position sensor SC81, that the movable plate 312 has reached the rear limit position, the supply of current to the movable plate motor MU2 and the unloading conveyor motor MU1 is cut off, such that the unloading conveyor 311 is stopped, and the movable plate 312 is stopped at the rear limit position.

When the movable plate 312 is stopped at the rear limit position, the current is supplied to the stack plate motor MU3, such that the stack plate 321 begins to move downward.

Figure 11:
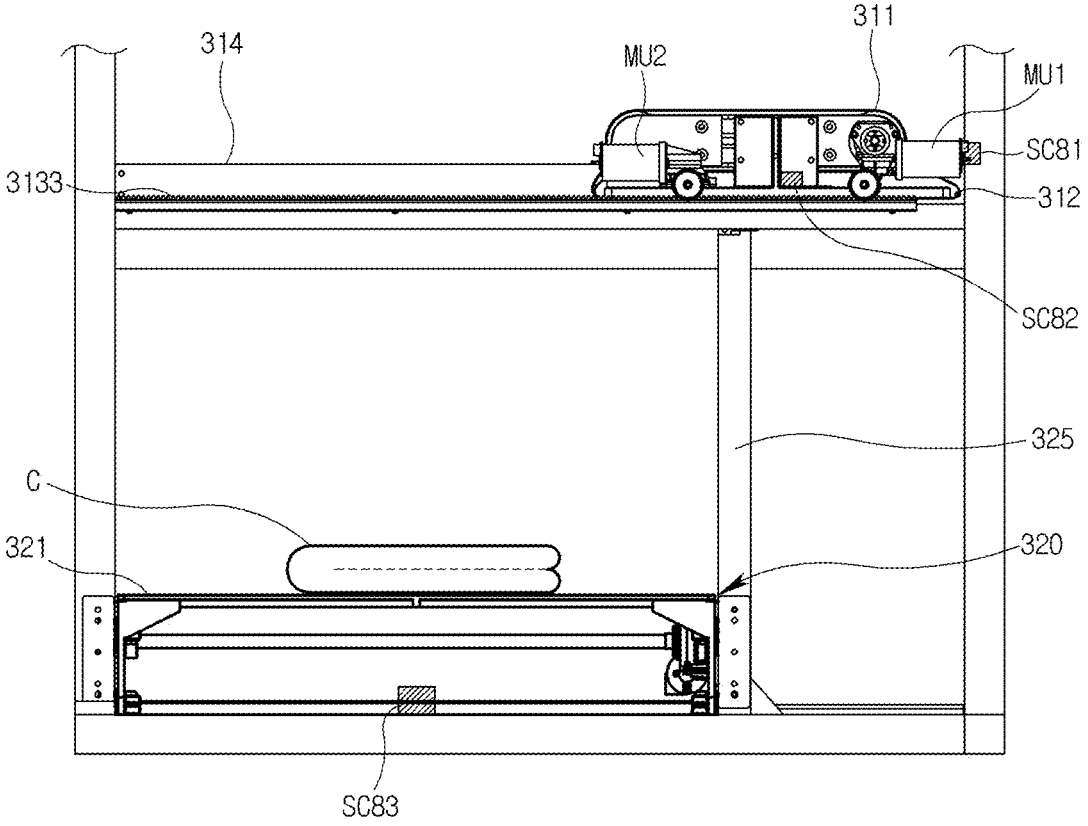

In this case, as described above, the stack plate 321 is moved to the lower limit position so that the garment treatment solution may be sprayed through the spray module 326. As illustrated in FIG. 11, when it is determined, based on the output signal from the stack plate position sensor SC83, that the stack plate 321 has reached the lower limit position, the supply of current to the stack plate motor MU3 is cut off, such that the stack plate 321 is stopped at the lower limit position.

Next, a process of preparing compression of the garment is initiated.

Figure 12:
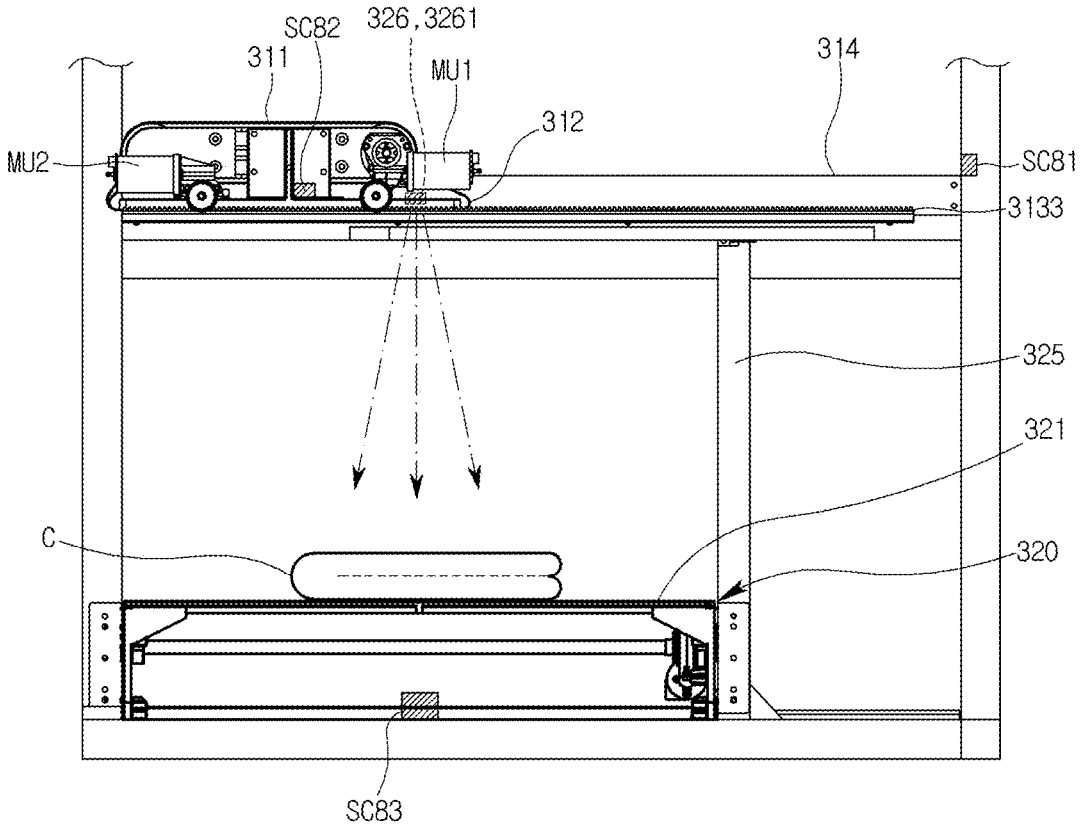
Figure 13:
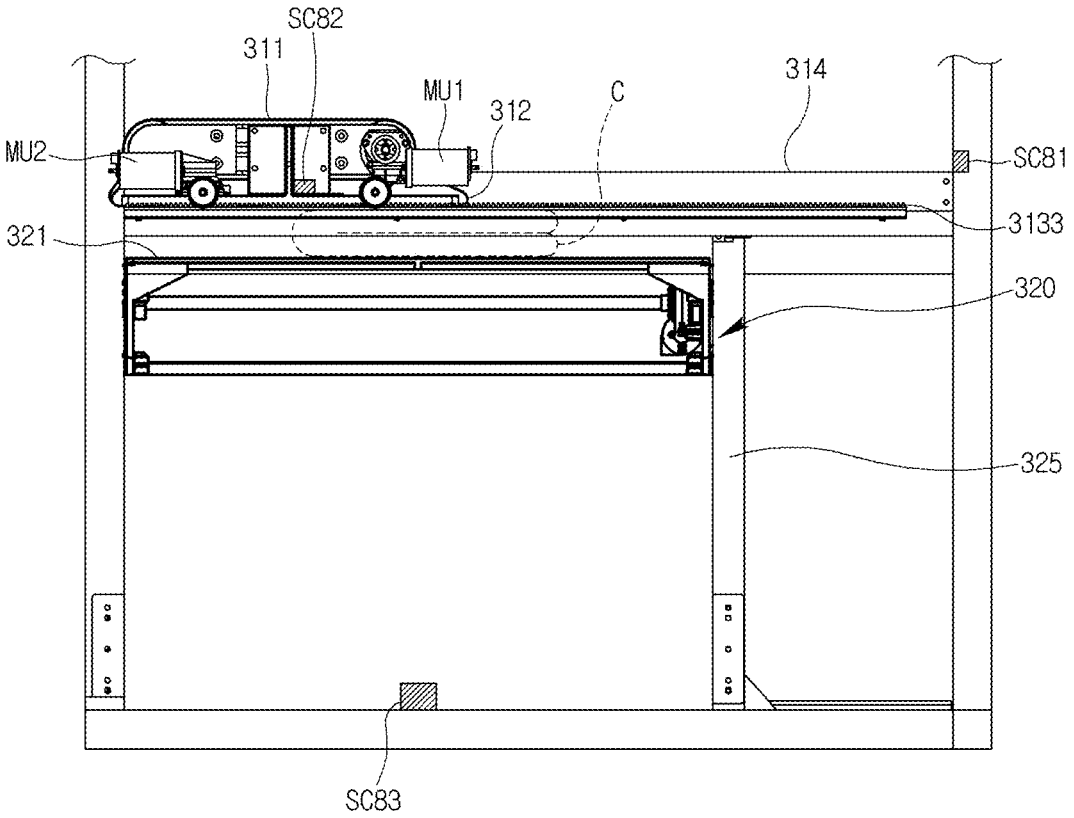

In more detail, as illustrated in FIG. 12, the current is supplied to the movable plate motor MU2 in order to operate, forward, the movable plate 312 which is stationary at the rear limit position.

When the forward operation of the movable plate 312 is initiated, whether the movable plate 312 has reached a predetermined target position is determined based on the output signal from the movable plate position sensor SC81.

The predetermined target position is an optimal position at which the garment treatment solution is sprayed through the spray nozzle 3261 of the spray module 326, as described below. The predetermined target position may be adjusted depending on a position at which the garments C are stacked, a size of the garment C, and a position at which the garment treatment solution is required to be sprayed.

Particularly, the predetermined target position may be identical to the front limit position or may be any position between the front limit position and the rear limit position.

For convenience, the embodiment in which the predetermined target position is the rear limit position, as illustrated in FIG. 12, will be described below, but the present disclosure is not limited thereto.

When it is determined, based on the output signal from the movable plate position sensor SC81, that the movable plate 312 has reached the front limit position as the predetermined target position, the supply of current to the movable plate motor MU2 is cut off, such that the movable plate 312 is stopped at the front limit position.

Next, when the movable plate 312 is stopped, the garment treatment solution is sprayed through the spray nozzle 3261 of the spray module 326 to the garment C seated on the stack plate 321.

As the spray module 326, any means well known in the art may be applied as long as this means may spray the garment treatment solution through the spray nozzle 3261 based on an electrical control signal.

In addition, in the illustrated in embodiment, the spray nozzle 3261 is illustrated as being provided below the movable plate 312, but this embodiment is provided for illustration only. A modified example in which the spray nozzle 3261 is installed at any position at which the spray nozzle 3261 may appropriately spray the garment treatment solution to the garment C may be applied, and the modified example of course falls into the scope of the present disclosure.

Meanwhile, when the process of spraying a preset amount of garment treatment solution through the spray nozzle 3261 is completed, the garment compressing process is initiated.

In more detail, first, the current is supplied to the stack plate motor MU3, such that the stack plate 321, which is stationary at the lower limit position, moves upward.

In this case, as a value of the current supplied to the stack plate motor MU3, a constant speed motor current value Ast, which is supplied to the stack plate motor MU3 while the stack plate 321 moves at a constant speed, is measured.

The constant speed motor current value Ast, which is supplied while the stack plate 321 moves at a constant speed, corresponds to the amount of load for moving the stack module 320 in the state in which the garment C is seated on the stack plate 321.

In addition, an operating time T, which elapses after the current is supplied to the stack plate motor MU3, is calculated.

Meanwhile, when the stack plate 321 continuously moves upward and the upper surface of the garment C reaches the lower surface of the movable plate 312, the seated garment C is continuously compressed by the stack plate 321 and the lower surface of the movable plate 312.

However, if the garment C is excessively compressed, there is a likelihood that the stack plate motor MU3 is damaged due to an overload of the stack plate motor MU3, which causes damage to the stack module 320, the movable plate 312, and the related components.

Therefore, the present disclosure provides a means for avoiding the overload or the damage to the components.

That is, when the compression of the garment C is initiated, whether a current motor current value Ac supplied to the movable plate motor MU2 exceeds a predetermined critical motor current value Ath is determined, or whether the operating time T exceeds a predetermined critical operating time Tth is determined. When it is determined that the current motor current value Ac is equal to or larger than the critical motor current value Ath or it is determined that the operating time T is equal to or larger than the predetermined critical operating time Tth, the supply of current to the stack plate motor MU3 is cut off, such that the stack plate 321 is stopped and the compression process is stopped.

In this case, the predetermined critical motor current value Ath is calculated by multiplying the constant speed motor current value Ast, which is supplied to the stack plate motor MU3 while the stack plate 321 moves at a constant speed, by a predetermined safety factor, and the safety factor is particularly 1.3 to 1.5. Further, the critical motor current value Ath may be limited to the maximum amount of load of the stack plate motor MU3, and the critical motor current value Ath, as the maximum amount of load, may be limited to less than 2 A.

In addition, the predetermined critical operating time Tth may particularly be 1.5 seconds to 2.5 seconds.

As described above, the amount of motor load required for the garment compressing process is limited to the predetermined critical motor current value Ath, and the motor operating time T is limited to the predetermined critical operating time Tth, such that the excessive compression of the garment C may be prevented, and stability and reliability of products may be improved.

Meanwhile, when the stack plate 321 is stopped to stop the operation of compressing the garment as described above, the current is supplied to the stack plate motor MU3, such that the stack plate 321 is moved downward to end the garment compressing process.

Figure 14:
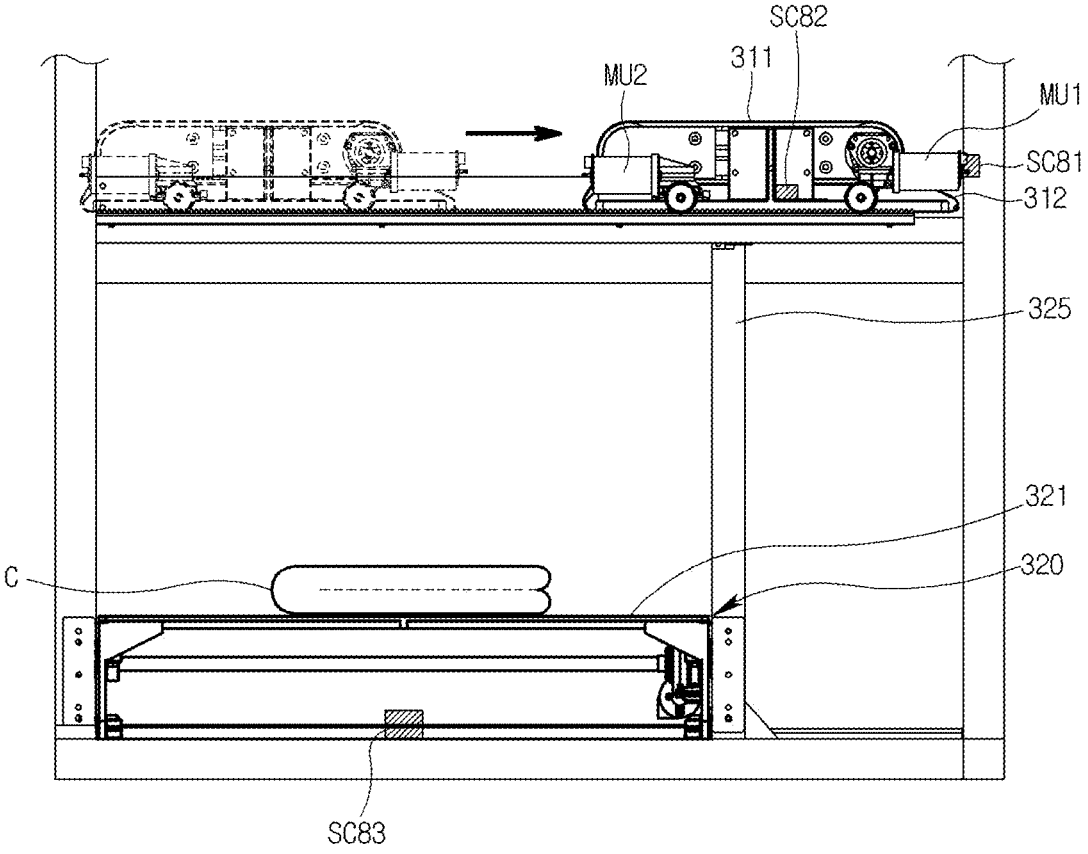

When the stack plate 321 begins to move downward, the stack plate 321 moves to the lower limit position. As illustrated in FIG. 14, when it is determined, based on the output signal from the stack plate position sensor SC83, that the stack plate 321 has reached the lower limit position, the supply of current to the stack plate motor MU3 is cut off, such that the stack plate 321 is stopped at the lower limit position.

When the stack plate 321 is stopped at the lower limit position, a process of initializing the position of the unloading layer 310 is finally initiated.

In more detail, in order to move the movable plate 312, which is on standby at the predetermined target position, to the rear limit position, the current is supplied to the movable plate motor MU2, such that the movable plate 312 is moved rearward.

After the movable plate 312 is moved rearward, whether the movable plate 312 has reached the rear limit position is determined based on the output signal from the movable plate position sensor SC81. When it is determined that the movable plate 312 has reached the rear limit position, the supply of current to the movable plate motor MU2 is cut off, such that the movable plate 312 is stopped, and the position of the movable plate 312 is initialized.

Figure 15:
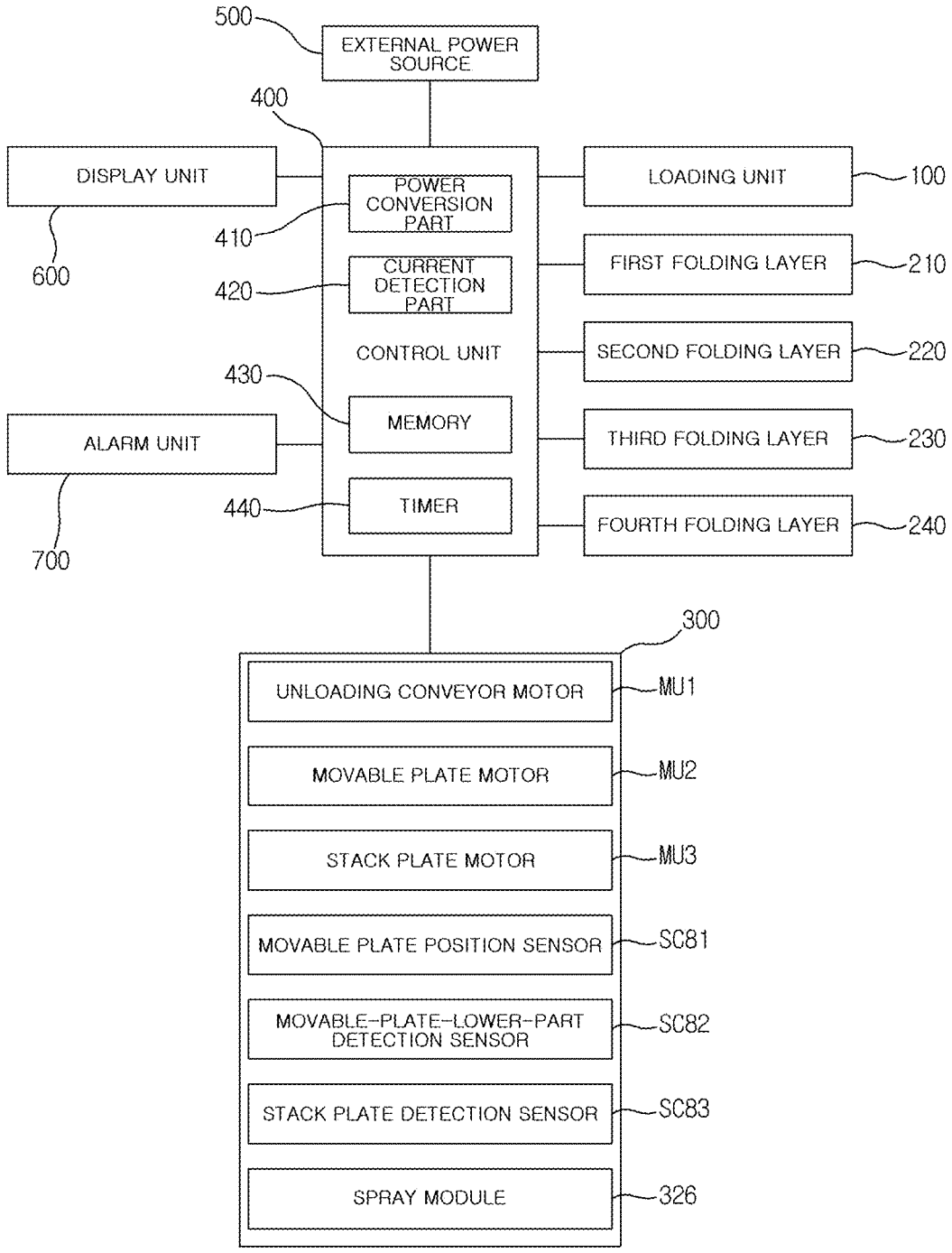
FIG. 15 is a functional block diagram for explaining a configuration of a control unit of the garment folding machine according to the present disclosure.
Figure 16:
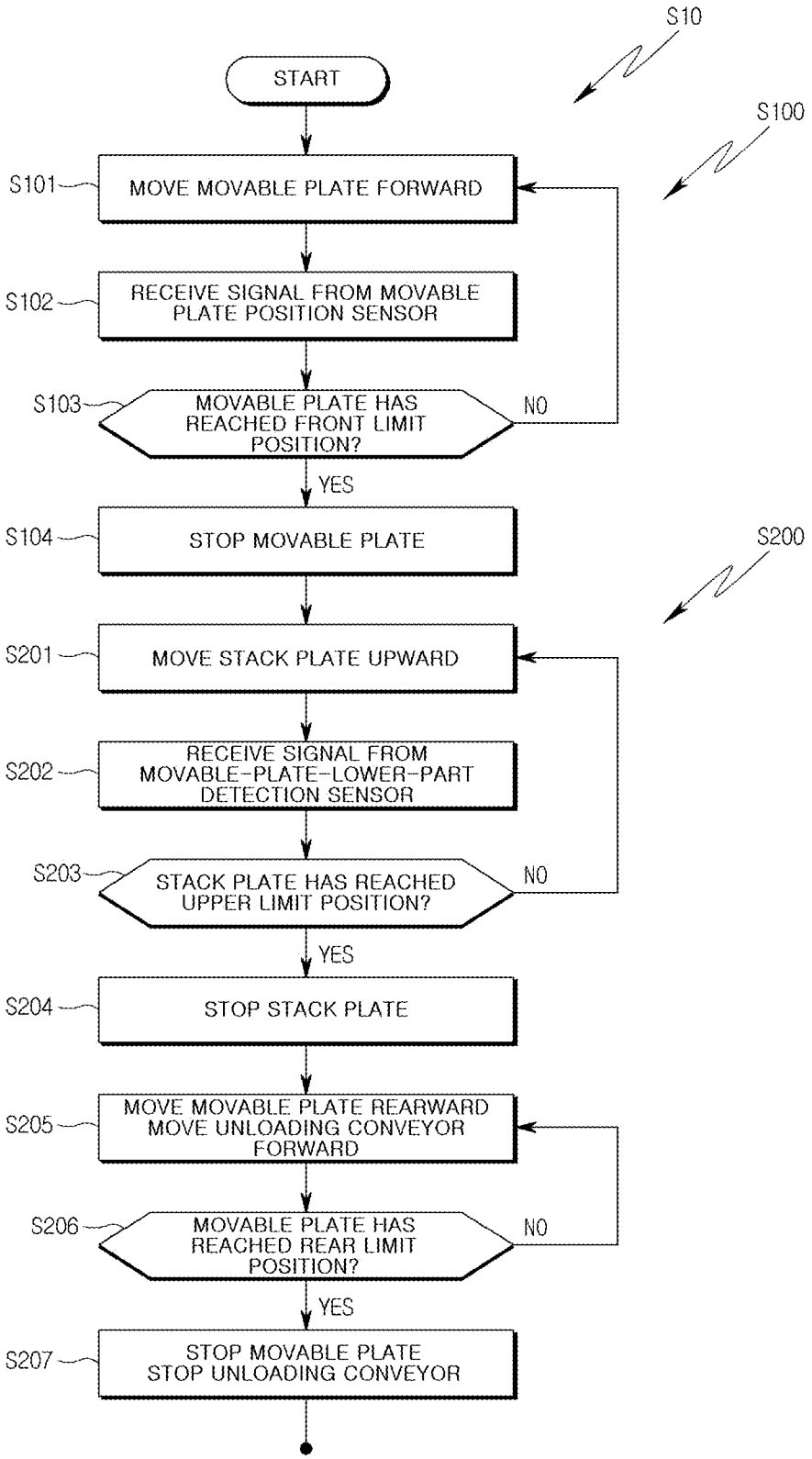
FIGS. 16 and 17 are flowcharts for explaining a primary garment seating step, a primary garment seating step, a garment compressing step, and an unloading layer position initializing step according to the present disclosure.
Figure 17:
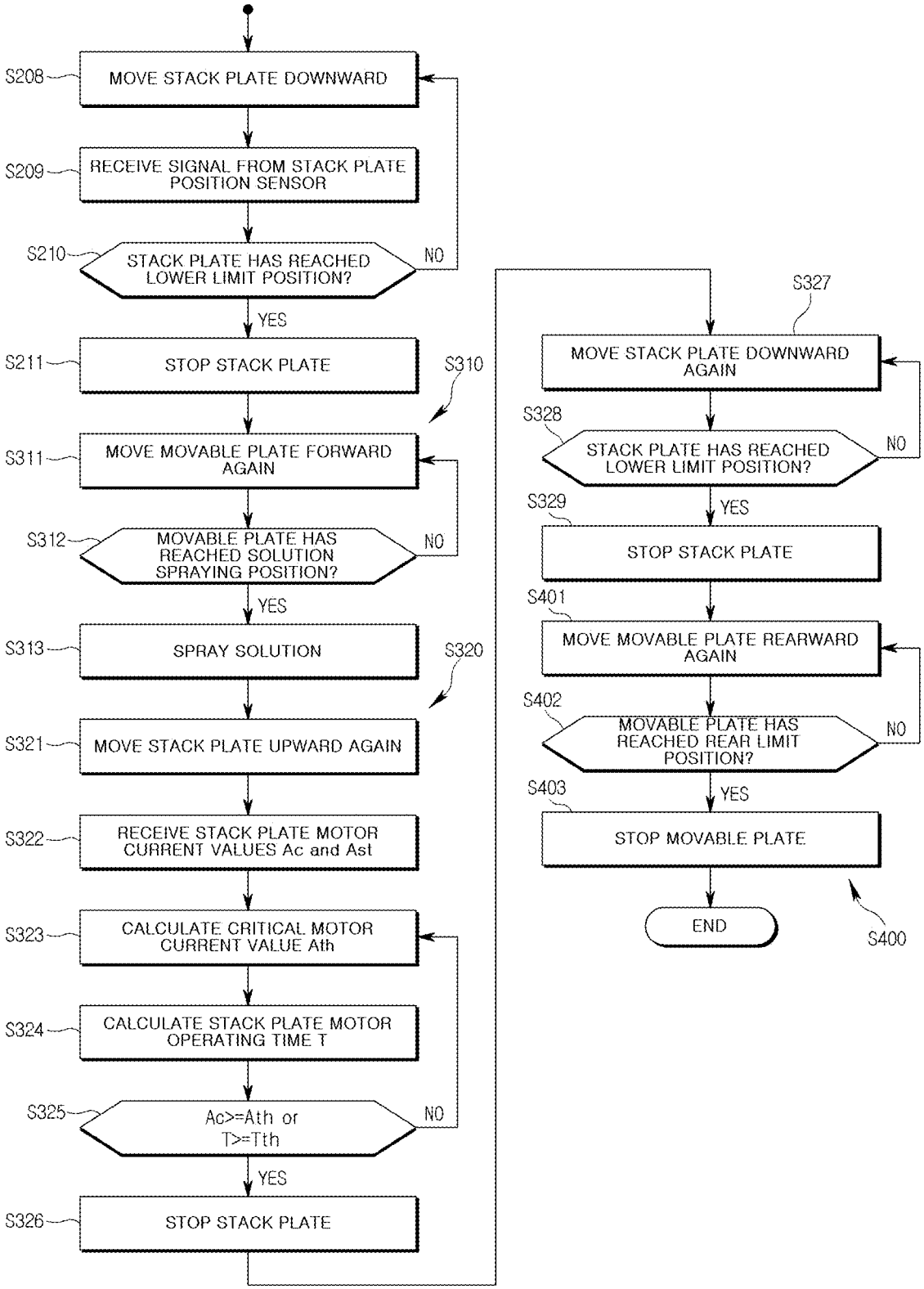

FIG. 15 is a functional block diagram illustrating a configuration of a control unit 400 of the garment folding machine 1 according to the present disclosure, and FIGS. 16 and 17 are flowcharts for explaining a primary garment seating step, a primary garment seating step, a garment compressing step, and an unloading layer position initializing step according to the present disclosure.

Hereinafter, a method of controlling the garment folding machine 1 according to the present disclosure will be described with reference to FIG. 15 and following drawings, focusing on the control unit 400.

As illustrated, the control unit 400 is electrically connected to the loading unit 100, the first folding layer 210, the second folding layer 220, the third folding layer 230, the fourth folding layer 240, and the unloading unit 300 and generates a control signal for controlling the loading unit 100, the first folding layer 210, the second folding layer 220, the third folding layer 230, the fourth folding layer 240, and the unloading unit 300.

Meanwhile, the control unit 400 may be electrically connected to the input unit (not illustrated) to receive a user's control instruction, and electrically connected to the display unit 600 and the alarm unit 700 to provide the display unit 600 and the alarm unit 700 with the information on the operating state of the garment folding machine 1, thereby transmitting the corresponding information to the user.

In addition, the control unit 400 controls a power conversion part 410 and a current detection part 420, the power conversion part 410 converts power inputted from the external power source 500 and supplies the power to the loading unit 200, first to fourth folding layers 210, 220, 230, and 240, and the unloading layer 310, and the current detection part 420 detects the electric current supplied from the power conversion part 410 to the loading unit 200, the first to fourth folding layers 210, 220, 230, and 240, and the unloading unit 300.

FIG. 15 illustrates the configuration in which the control unit 400 includes the power conversion part 410 and the current detection part 420, but the present disclosure is not limited thereto. It can be seen that a configuration in which the power conversion part 410 and the current detection part 420 are provided independently of the control unit 400 also falls into the scope of the present disclosure. For convenience, the embodiment in which the control unit 400 includes the power conversion part 410 and the current detection part 420 will be described below.

Referring to FIG. 16, the control unit 400 performs a primary garment seating step S100 of primarily seating the garment C, which is delivered from the fourth folding layer, on the unloading conveyor 311 of the unloading layer 310.

In more detail, first, the control unit 400 supplies the current to the movable plate motor MU2 through the power conversion part to move the movable plate 312 forward in order to move the unloading conveyor 311 and the movable plate 312 forward in the state in which the unloading conveyor 311 and the movable plate 312 are stationary and on standby at the rear limit position (S101). As described above, the garment is dropped from the fourth folding layer while the movable plate 312 moves forward, and the garment is primarily seated on the upper surface of the unloading conveyor 311.

After the movable plate 312 moves forward in step S101, the control unit 400 receives the output signal from the movable plate position sensor SC81 (S102).

Whether the movable plate 312 has reached the front limit position is determined based on the output signal received from the plate position sensor in step S102 (S103).

When it is determined in step S103 that the movable plate 312 has reached the front limit position, the control unit 400 stops the movable plate 312 at the front limit position by cutting off the supply of current to the movable plate motor MU2 through the power conversion part (S104).

When the movable plate 312 is stopped at the front limit position in step S104, the primary garment seating step S100 is ended, and the secondary garment seating step S200 is initiated.

In more detail, in order to move the stack plate 321 upward in the state in which the stack plate 321 is on standby at the lower limit position, the control unit 400 moves the stack plate 321 upward by supplying the current to the stack plate motor MU3 through the power conversion part (S201).

When the stack plate 321 moves upward in step S201, the control unit 400 receives the output signal from the movable-plate-lower-part detection sensor SC82 (S202).

Based on the output signal received from the movable-plate-lower-part detection sensor SC82 in step S202, the control unit 400 determines whether the position of the upper surface of the stack plate 321 (the position of the upper surface of the garment in the state in which the garments are stacked on the stack plate 321) has reached the upper limit position (S203).

When it is determined in step S203 that the position of the upper surface of the stack plate 321 (the position of the upper surface of the garment in the state in which the garments are stacked on the stack plate 321) has reached the upper limit position, the control unit 400 stops the stack plate 321 at the upper limit position by cutting off the supply of current to the stack plate motor MU3 through the power conversion part (S204).

When the stack plate 321 is stopped at the upper limit position in step S203, in order to drop the garment primarily seated on the upper surface of the unloading conveyor 311 and secondarily seat the garment, the control unit 400 moves the movable plate 312 rearward by supplying the current to the movable plate motor MU2 through the power conversion part and moves the unloading conveyor 311 forward by supplying the current to the unloading conveyor motor MU1 (S205).

In this case, in order to adjust the point in time at which the current is supplied to the unloading conveyor motor MU1 based on the size of the garment and the position at which the garment is dropped on the stack plate 321 as described above, the point in time at which the current is supplied to the unloading conveyor motor MU1 may be controlled to be equal to or different from the point in time at which the current is supplied to the movable plate motor MU2.

After the movable plate 312 moves rearward and the unloading conveyor 311 moves forward in step S205, the control unit 400 determines whether the movable plate 312 has reached the rear limit position based on the output signal from the movable plate position sensor SC81 (S206).

When it is determined in step S206 that the movable plate 312 has reached the rear limit position, the control unit 400 stops the movable plate 312 and the unloading conveyor 311 by cutting off the supply of current to the movable plate motor MU2 and the unloading conveyor motor MU1 through the power conversion part (S207).

When the movable plate 312 and the unloading conveyor 311 are stopped in step S207, the control unit 400 moves the stack plate 321 downward by supplying the current to the stack plate motor MU3 through the power conversion part in order to move the stack plate 321 downward in the state in which the garment is secondarily seated on the stack plate 321 (S208).

When the downward movement of the stack plate 321 is initiated in step S208, the control unit 400 receives the output signal from the stack plate position sensor SC83 (S209).

Based on the output signal received from the stack plate position sensor SC83 in step S209, the control unit 400 determines whether the stack plate 321 has reached the lower limit position (S210).

When it is determined in step S210 that the stack plate 321 has reached the lower limit position, the control unit 400 stops the stack plate 321 at the lower limit position by cutting off the supply of current to the stack plate motor MU3 through the power conversion part (S211).

When the stack plate 321 is stopped at the lower limit position in step S211, the secondary garment seating step S200 is completed, and the garment compressing step S300 is initiated.

In more detail, the garment compressing step S300 may include a garment compression preparing step S310 and a garment compression performing step S320.

The garment compression preparing step S310 means a step of preparing in advance the garment compression performing step S320.

In detail, in the garment compression preparing step S310, the control unit 400 moves the movable plate 312 forward again by supplying the current to the movable plate motor MU2 through the power conversion part in order to move forward the movable plate 312 which is stationary at the rear limit position (S311).

When the movable plate 312 moves forward in step S311, the control unit 400 determines whether the movable plate 312 has reached the predetermined target position based on the output signal from the movable plate position sensor SC81 (S312).

In this case, the predetermined target position is an optimal position at which the garment treatment solution is sprayed through the spray nozzle 3261 of the spray module 326 as described above. The predetermined target position may be adjusted depending on the position at which the garments are stacked, the size of the garment, and the position at which the garment treatment solution is required to be sprayed. The predetermined target position may be identical to the front limit position or may be any position between the front limit position and the rear limit position.

When it is determined in step of S312 that the movable plate 312 has reached the predetermined target position, the control unit 400 stops the movable plate 312 at the predetermined target position by cutting off the supply of current to the movable plate motor MU2 through the power conversion part and allows the spray nozzle 3261 of the spray module 326 to spray the garment treatment solution to the garment seated on the stack plate 321 (S313).

When the process of spraying a preset amount of garment treatment solution is completed in step S313, the garment compression preparing step S310 is completed.

When the garment compression preparing step S310 is completed, the control unit 400 performs the garment compression performing step S320.

In more detail, in order to move upward the stack plate 321 which is stationary at the lower limit position, the control unit 400 moves the stack plate 321 upward again by supplying the current to the stack plate motor MU3 through the power conversion part (S321).

When the stack plate 321 moves upward again in step S321, the control unit 400 receives, from the current detection part, the motor current value supplied to the stack plate motor MU3 through the power conversion part, and particularly, receives the constant speed motor current value Ast supplied to the stack plate motor MU3 while the stack plate 321 moves at a constant speed (S322).

When the constant speed motor current value Ast is received in step S322, the control unit 400 calculates the critical motor current value Ath by multiplying the received constant speed motor current value Ast by a predetermined safety factor (S323).

In this case, the safety factor is particularly 1.3 to 1.5. In addition, the critical motor current value Ath may be limited to the maximum amount of load of the stack plate motor MU3, and the critical motor current value Ath, as the maximum amount of load, may be limited to less than 2 A.

Next, the control unit 400 uses the timer and calculates the operating time T that has elapsed after supplying the current to the stack plate motor MU3 in step S321 (S324).

When the critical motor current value Ath and the operating time T are calculated in steps S323 and S324, the control unit 400 determines whether the current motor current value Ac exceeds the calculated critical motor current value Ath or whether the calculated operating time T exceeds the predetermined critical operating time Tth (S325).

In this case, the predetermined critical operating time Tth may particularly be 1.5 seconds to 2.5 seconds.

When it is determined that the current motor current value Ac is equal to or larger than the critical motor current value Ath or it is determined that the operating time T is equal to or larger than the predetermined critical operating time Tth in step S325, the control unit 400 stops the stack plate 321 and the pressing by cutting off the supply of current to the stack plate motor MU3 through the power conversion part (S326).

As described above, according to the present disclosure, the amount of motor load required for the garment compressing process is limited to the predetermined critical motor current value Ath, and the motor operating time T is limited to the predetermined critical operating time Tth, such that the excessive compression of the garment may be prevented, and stability and reliability of products may be improved.

When the stack plate 321 is stopped in step S326, the control unit 400 moves the stack plate 321 downward again by supplying the current to the stack plate motor MU3 through the power conversion part in order to move the stack plate 321 downward (S327).

When the stack plate 321 moves downward again in step S327, the control unit 400 determines whether the stack plate 321 has reached the lower limit position based on the output signal from the stack plate position sensor SC83 (S328).

When it is determined in step S328 that the stack plate 321 has reached the lower limit position, the control unit 400 stops the stack plate 321 at the lower limit position by cutting off the supply of current to the stack plate motor MU3 through the power conversion part (S329).

When the stack plate 321 is stopped at the lower limit position in step S329, the garment compression performing step S320 is ended, and the unloading layer position initializing step S400 is performed.

In more detail, in order to move the movable plate 312, which is on standby at the predetermined target position, to the rear limit position, the control unit 400 moves the movable plate 312 rearward again by supplying the current to the movable plate motor MU2 through the power conversion part (S401).

When the movable plate 312 moves rearward again in step S401, the control unit 400 determines whether the movable plate 312 has reached the rear limit position based on the output signal from the movable plate position sensor SC81 (S402).

When it is determined in step S402 that the movable plate 312 has reached the rear limit position, the control unit 400 stops the movable plate 312 at the rear limit position and initializes the position of the movable plate 312 by cutting off the supply of current to the movable plate motor MU2 through the power conversion part (S402).

It can be understood that the above-mentioned technical features of the present disclosure may be carried out in any other specific form by those skilled in the art without changing the technical spirit or the essential features of the present disclosure.

Accordingly, it should be understood that the aforementioned embodiments are described for illustration in all aspects and are not limited, and the scope of the present disclosure shall be represented by the claims to be described below, and it should be construed that all of the changes or modified forms derived from the meaning and the scope of the claims, and an equivalent concept thereto are included in the scope of the present disclosure.

DESCRIPTION OF REFERENCE NUMERALS

1: Garment folding machine
100: Loading unit
200: Folding unit
210: First folding layer
211: First conveyor
M1: First conveyor motor
SC1: First-conveyor-rear-end garment detection sensor
220: Second folding layer
221: Second conveyor
M21: Second conveyor motor
222: Vertical folding assembly
230: Third folding layer
231: Third conveyor
M31: Third conveyor motor
SC3: Third-conveyor-rear-end garment detection sensor
232: Fourth conveyor
M32: Fourth conveyor motor
SC4: Fourth-conveyor-lower-part garment detection sensor
240: Fourth folding layer
241: Fifth conveyor
M41: Fifth conveyor motor
242: Sixth conveyor
M42: Sixth conveyor motor
SC61: Sixth-conveyor-rear-lower-part garment detection sensor
SC62: Sixth-conveyor-front-lower-part garment detection sensor
243: Seventh conveyor
M43: Seventh conveyor motor
SC7: Seventh-conveyor-rear-end garment detection sensor
300: Unloading unit
310: Unloading layer
311: Unloading conveyor
MU: Unloading conveyor motor
312: Movable plate
MU2: Movable plate motor
320: Stack module
321: Stack plate
MU3: Stack plate motor
SC81: Movable plate position sensor
SC82: Movable-plate-lower-part detection sensor
SC83: Stack plate position sensor

What is claimed is:

1. A method of controlling a garment folding machine comprising:

a plurality of folding layers configured to fold a garment or convey the garment;

an unloading layer configured to receive the garment folded by the plurality of folding layers;

a stack module configured to receive the garment from the unloading layer, the method comprising:

a primary garment seating step of primarily seating the garment delivered from the plurality of folding layers on an unloading conveyor in the unloading layer;

a secondary garment seating step of secondarily seating the garment on a stack plate by delivering the garment primarily seated in the primary garment seating step to the stack plate of the stack module from the unloading conveyor; and a garment compressing step of compressing the garment secondarily seated in the secondary garment seating step between the stack plate and a movable plate in the unloading layer, wherein the garment compressing step comprises:

a garment compression preparing step of moving, from a rear limit position at which the unloading conveyor and the movable plate are located after the garment is delivered to the stack plate in the secondary garment seating step, the unloading conveyor and the movable plate forward toward a predetermined target position, and a garment compression performing step of moving upward the stack plate from a lower limit position at which the stack plate is located after the unloading conveyor and the movable plate are moved to the predetermined target position in the garment compression preparing step.

2. The method of claim 1, wherein the garment compression preparing step comprises:

a movable-plate-forward-movement step of moving the unloading conveyor and the movable plate, which are on standby at the rear limit position, toward the predetermined target position by supplying a current to a movable plate motor through a power conversion part; and a reach-to-target-position determining step of determining, after the movable-plate-forward-movement step, whether the movable plate has reached the predetermined target position by receiving an output signal from a movable plate position sensor that detects a position of the movable plate.

3. The method of claim 2, wherein the garment compression preparing step further comprises:

a solution spraying step of stopping, based on a determination in the reach-to-target-position determining step that the movable plate has reached the predetermined target position, the movable plate by cutting of the supply of current to the movable plate motor through the power conversion part and spraying a garment treatment solution toward the garment through a nozzle provided at a lower side of the movable plate.

4. The method of claim 2, wherein the predetermined target position is a front limit position at which the movable plate cannot move forward any further.

5. The method of claim 1, wherein the garment compression performing step comprises:

a stack-plate-upward movement step of moving upward the stack plate, which is on standby at the lower limit position, by supplying a current to a stack plate motor through a power conversion part;

a stack plate motor current value receiving step of receiving, through the power conversion part, a motor current value supplied to the stack plate motor in the stack-plate-upward movement step;

a critical motor current value calculating step of calculating a critical motor current value based on a constant speed motor current value among the motor current values received in the stack plate motor current value receiving step;

a stack plate motor operating time calculating step of calculating an operating time after the current is supplied to the stack plate motor in the stack-plate-upward movement step; and a current-value-and-operating-time determining step of determining whether a current motor current value supplied to the current stack plate motor exceeds the critical motor current value and whether the calculated operating time exceeds a predetermined critical operating time.

6. The method of claim 5, wherein the critical motor current value is calculated by multiplying a constant speed motor current value, which is supplied while the stack plate motor rotates at a constant speed among the motor current values received in the stack plate motor current value receiving step, by a predetermined safety factor.

7. The method of claim 6 wherein the safety factor is 1.3 to 1.5.

8. The method of claim 5, wherein the predetermined critical operating time is 1.5 seconds to 2.5 seconds.

9. The method of claim 5, wherein the garment compression performing step further comprises:

a stack-plate-pressing stopping step of stopping, based on a determination in the current-value-and-operating-time determining step that (i) the current motor current value is greater than or equal to the critical motor current value or (ii) the calculated operating time is greater than or equal to the predetermined critical operating time, the stack plate by cutting off the supply of current to the stack plate motor through the power conversion part; and a stack-plate-downward-movement step of moving the stack plate downward by supplying a current to the stack plate motor through the power conversion part after the stack plate stopping step.

10. The method of claim 9, wherein the garment compression performing step further comprises:

a reach-to-lower-limit-position determining step of determining, after the stack-plate-downward-movement step, whether the stack plate has reached the lower limit position by receiving an output signal from a stack plate position sensor provided at a lower side of the stack plate.

11. The method of claim 10, wherein the garment compression performing step further comprises:

a stack plate stopping step of stopping, based on a determination in the reach-to-lower-limit-position determining step that the stack plate has reached the lower limit position, the stack plate by cutting off the supply of current to the stack plate motor through the power conversion part.

12. The method of claim 11, further comprising:

an unloading layer position initializing step of initializing, after the stack plate stopping step, a position of the unloading layer by moving the movable plate, which is on standby at the predetermined target position, to the rear limit position.

13. The method of claim 12, wherein the unloading layer position initializing step comprises:

a movable-plate-rearward-movement step of moving rearward the movable plate, which is on standby at the predetermined target position, by supplying a current to a movable plate motor through the power conversion part;

a reach-to-rear-limit-position determining step of determining whether the movable plate has reached the rear limit position by receiving an output signal from a movable plate position sensor after the movable plate moves rearward in the movable-plate-rearward-movement step; and a movable plate stopping step of stopping, based on a determination in the reach-to-rear-limit-position determining step that the movable plate has reached the rear limit position, the movable plate by cutting off the supply of current to the movable plate motor through the power conversion part.

14. The method of claim 5, wherein the critical motor current value is less than a maximum amount of load of the stack plate motor.

15. The method of claim 5, wherein the critical motor current value is less than 2 A.

* * * * *